US011974615B2

(12) United States Patent
Zeppetella

(10) Patent No.: US 11,974,615 B2
(45) Date of Patent: May 7, 2024

(54) GARMENT WITH OPENINGS FOR SAFETY HARNESS

(71) Applicant: 2529117 Ontario Inc., St. Catharines (CA)

(72) Inventor: Pete Zeppetella, St. Catharines (CA)

( * ) Notice: Subject to any disclaimer, the term of this patent is extended or adjusted under 35 U.S.C. 154(b) by 0 days.

(21) Appl. No.: 17/459,000

(22) Filed: Aug. 27, 2021

(65) Prior Publication Data

US 2022/0061416 A1 Mar. 3, 2022

Related U.S. Application Data

(60) Provisional application No. 63/071,628, filed on Aug. 28, 2020.

(51) Int. Cl.
*A41D 13/00* (2006.01)
*A41D 27/20* (2006.01)

(52) U.S. Cl.
CPC ..... *A41D 13/0007* (2013.01); *A41D 27/20* (2013.01)

(58) Field of Classification Search
CPC ..... A41D 13/0007; A41D 27/201; A41D 27/202; A41D 27/205
See application file for complete search history.

(56) References Cited

U.S. PATENT DOCUMENTS 472,273 A * 4/1892 Rupprecht ..... A41F 9/02 D2/742
1,060,489 A * 4/1913 Pennewill ..... A41D 27/20 2/254
1,337,698 A * 4/1920 Gongora ..... A41D 27/201 2/DIG. 2
1,982,845 A * 12/1934 Wagman ..... A45C 3/06 383/33
2,073,231 A * 3/1937 Siegel ..... A41D 3/02 2/97
2,123,447 A * 7/1938 Waite ..... A45D 44/08 D2/857
2,324,722 A * 7/1943 Papierniak ..... A41D 3/00 2/93
3,217,335 A * 11/1965 Bell ..... A41D 27/20 2/93
3,334,357 A * 8/1967 Stults ..... A41D 27/20 2/247
4,208,743 A * 6/1980 Whitcraft ..... A41D 1/215 2/104
4,513,455 A * 4/1985 Gerhardt ..... C07C 51/353 D2/857
4,731,883 A * 3/1988 Foster ..... A41D 27/28 2/DIG. 1
4,813,080 A * 3/1989 Toso ..... A41D 13/0007 5/652

(Continued)

*Primary Examiner* — Alissa L Hoey
(74) *Attorney, Agent, or Firm* — Norton Rose Fulbright Canada LLP

(57) ABSTRACT

A garment for use by a user wearing a safety harness includes a garment body having a front side and a rear side, an opening having a shape defined in the front side of the garment body and partially retained by a flexible portion, a releasable closure disposed on the garment body adjacent the opening and configured to cover the opening. The flexible portion allows the shape of the opening to expand to allow a portion of the safety harness to extend through the opening without displacing the garment body.

5 Claims, 27 Drawing Sheets

(56) References Cited

U.S. PATENT DOCUMENTS 5,105,477 A * 4/1992 Golde ..... A41D 27/10 2/93
6,240,564 B1 * 6/2001 Te Kanawa ..... A41D 13/0015 2/69
6,263,510 B1 * 7/2001 Bay ..... A41D 27/28 2/93
6,328,146 B1 * 12/2001 Siwak ..... A45C 5/06 383/117
6,339,845 B1 * 1/2002 Burns ..... A41D 31/102 2/243.1
6,662,372 B2 * 12/2003 Lewis ..... A41D 13/0007 2/81
6,766,565 B2 * 7/2004 Crye ..... A41D 27/28 24/104
7,356,850 B2 * 4/2008 Turcotte ..... A41D 13/0007 2/69
RE40,613 E * 1/2009 Jordan ..... A41D 13/0012 2/94
7,571,494 B2 * 8/2009 Grilliot ..... A62B 35/0037 2/69
7,620,998 B2 * 11/2009 Sandoval ..... D05C 9/00 2/253
7,707,660 B2 * 5/2010 Grilliot ..... A41D 13/0007 2/93
7,757,304 B1 * 7/2010 Real ..... A41D 13/0007 2/69
7,784,109 B2 * 8/2010 Seguin ..... A41D 13/0012 2/93
8,001,618 B2 * 8/2011 Bay ..... A41D 27/28 2/96
8,002,082 B2 * 8/2011 Snedeker ..... A62B 35/0006 2/69
8,234,720 B2 * 8/2012 Freedman ..... A41D 27/201 2/253
8,276,213 B2 * 10/2012 Maurer ..... A41D 27/24 2/248
8,332,967 B2 * 12/2012 Echikson ..... F41C 33/048 2/250
8,375,467 B2 * 2/2013 Real ..... A62B 35/0018 2/69
8,402,562 B1 * 3/2013 Seddiki ..... A41D 27/205 2/247
8,430,204 B1 * 4/2013 Reynolds ..... A62B 35/0006 2/93
8,448,264 B2 * 5/2013 Ellsworth ..... A41D 3/00 2/96
8,505,118 B2 * 8/2013 Bang ..... A41D 27/20 2/247
8,756,716 B2 * 6/2014 Jordan ..... A41D 1/005 2/247
8,776,266 B1 * 7/2014 Metz ..... A41D 13/0007 2/93
8,850,615 B2 * 10/2014 Demarest ..... A41D 13/002 2/DIG. 1
8,931,113 B2 * 1/2015 Greer ..... A41D 13/0007 2/69
9,066,547 B2 * 6/2015 Kim ..... A41D 27/20
9,301,556 B2 * 4/2016 Koller ..... A41D 3/02
9,392,860 B2 * 7/2016 Redli ..... A41D 3/00
9,474,311 B2 * 10/2016 Short ..... A41B 1/10
10,016,002 B2 * 7/2018 Murphy ..... A62B 35/0025
10,259,518 B2 * 4/2019 Jarmon ..... A41D 3/00
10,342,271 B1 * 7/2019 Douglas ..... A41D 1/02
10,721,979 B2 * 7/2020 White, Jr. ..... A41D 27/201
10,750,801 B2 * 8/2020 Bentley ..... A41D 27/201
10,791,775 B2 * 10/2020 Grogro ..... A41D 31/02
10,834,983 B2 * 11/2020 Cherry ..... A41D 27/20
10,894,176 B2 * 1/2021 Derrick ..... A62B 35/0043
11,129,423 B2 * 9/2021 Zeppetella ..... A41D 13/0007
11,375,760 B2 * 7/2022 Rutten ..... A62B 35/0025
2005/0005341 A1 * 1/2005 Roux ..... A41D 13/0007 2/69
2007/0192926 A1 * 8/2007 Fee ..... A62B 35/0037 2/81
2008/0060112 A1 * 3/2008 Driehorst ..... A41D 13/015 2/85
2008/0256680 A1 * 10/2008 Peksoz ..... A62B 35/0006 2/93
2009/0229037 A1 * 9/2009 Bugni ..... A41D 27/20 2/250
2010/0235966 A1 * 9/2010 DeHart ..... A41D 27/20 2/272
2011/0030118 A1 * 2/2011 Pratchett ..... A62B 35/0025 2/243.1
2011/0214218 A1 * 9/2011 Bonamer ..... A41D 27/00 2/243.1
2012/0304357 A1 * 12/2012 Highfield ..... A41D 27/205 2/69
2015/0108182 A1 * 4/2015 Bruce ..... A63B 55/40 224/148.1
2015/0305420 A1 * 10/2015 Daniels ..... A41D 1/02 2/93
2015/0359269 A1 * 12/2015 Rapp ..... A41D 27/20 2/93
2016/0278454 A1 * 9/2016 Lucas ..... A41D 13/0007
2019/0082750 A1 * 3/2019 Matuszak ..... A62B 35/0006
2020/0060357 A1 * 2/2020 Duran ..... A41D 1/02
2021/0093026 A1 * 4/2021 Halerz-Sroczynski ..... A41D 13/0007

* cited by examiner

GARMENT WITH OPENINGS FOR SAFETY HARNESS

FIELD

This disclosure relates to body garments, in particular garments for use with safety equipment such as a safety harness.

BACKGROUND

Safety harnesses are typically worn by users for fall protection, suspension or retrieval. A traditional safety harness will include one or more attachment points (such as D-rings) that can be connected to an anchor point.

To effectively support a user's body, a safety harness should be securely fastened to the user with a combination of straps, such as against the user's upper thighs, pelvis, chest and shoulders, to snugly retain the safety harness against the user's body.

Certain garments, for example, outwear garments such as jackets, vests or coveralls, may present challenges in being worn with a safety harness.

A garment worn underneath a safety harness can impact the fit of the safety harness against the user's body, and be difficult to remove once the safety harness is fastened and in use.

A garment worn over a safety harness can impact accessibility to the attachment points of the safety harness, that may need to remain easily and quickly accessible.

SUMMARY

According to an aspect, there is provided a garment for use by a user wearing a harness or safety harness, the garment comprising: a garment body having a front side and a rear side; an opening having a shape defined in the front side of the garment body and partially retained by a flexible portion; and a releasable closure disposed on the garment body adjacent the opening and configured to cover the opening, wherein the flexible portion allows the shape of the opening to expand to allow a portion of the safety harness to extend through the opening without displacing the garment body.

In some embodiments, the opening is adjacent a hand-level pocket of the garment.

In some embodiments, the flexible portion is formed from elasticized fabric.

In some embodiments, the flexible portion is releasable using a fastener.

In some embodiments, the closure is a fabric flap.

In some embodiments, the closure is disposed within a hand-level pocket of the garment.

In some embodiments, the garment is a jacket, a shirt, or coveralls.

Other features will become apparent from the drawings in conjunction with the following description.

BRIEF DESCRIPTION OF DRAWINGS

In the figures which illustrate example embodiments.

DETAILED DESCRIPTION

Embodiments of a garment disclosed herein can be used with equipment such as a harness or a safety harness (for example, a fall-arrest harness), while allowing for attachment points of the safety harness to remain easily and quickly accessible.

Traditional use of a garment, such as a jacket or vest as needed in cold weather, under a safety harness can restrict a user's movement and prevent the safety harness from working properly. The presence of a bulky garment between the safety harness and the user may prevent the safety harness from being sufficiently secured in a snug fit against the user's body, leading to potential injuries or death should a fall event occur. In situations in which users might frequently put on and take off such garments, the temptation to "cut corners" and fail to properly wear and connect the safety harness may be present.

If a user wears a garment over a safety harness, the movement of a lanyard connected to an attachment point of the safety harness can be restricted. In the event of a fall, the force on the lanyard and angle of the lanyard and harness can result in the garment wrenching the body or restricting the mobility of the user, and in some cases choking the user.

Conveniently, some embodiments of a garment as disclosed herein may improve workplace safety associated with using a garment such as a jacket or vest with a safety harness.

The present device may allow the wearer to properly wear a safety harness while wearing an outerwear garment without impeding proper access and use of the safety harness, and without restricting movement of safety harness attachments and the harness itself, thus relieving the impact of any force the outerwear garment could otherwise have had on the wearer.

Figure 1:
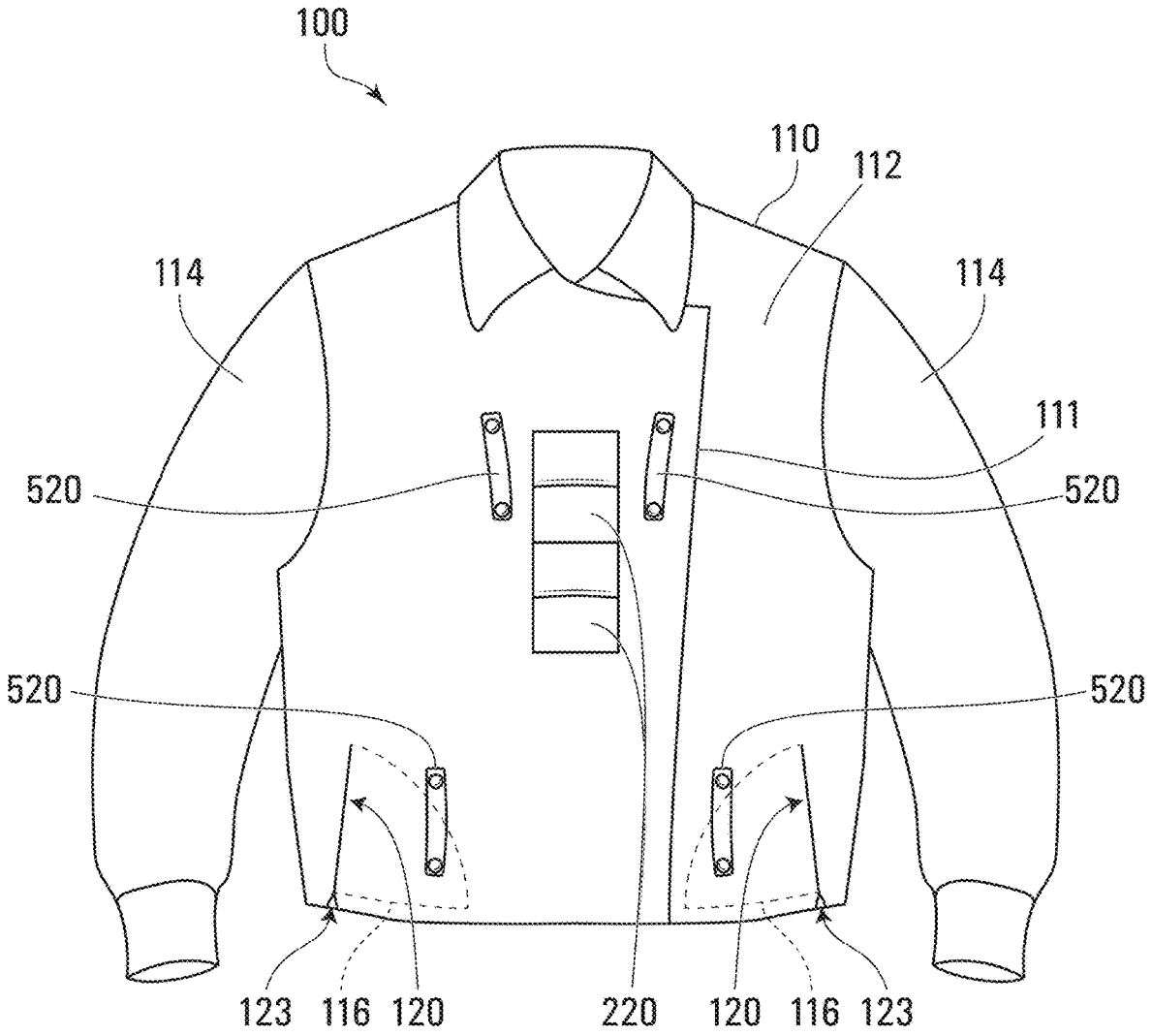
FIG. 1 is a front view of a garment including a pocket access, according to an embodiment.
Figure 2:
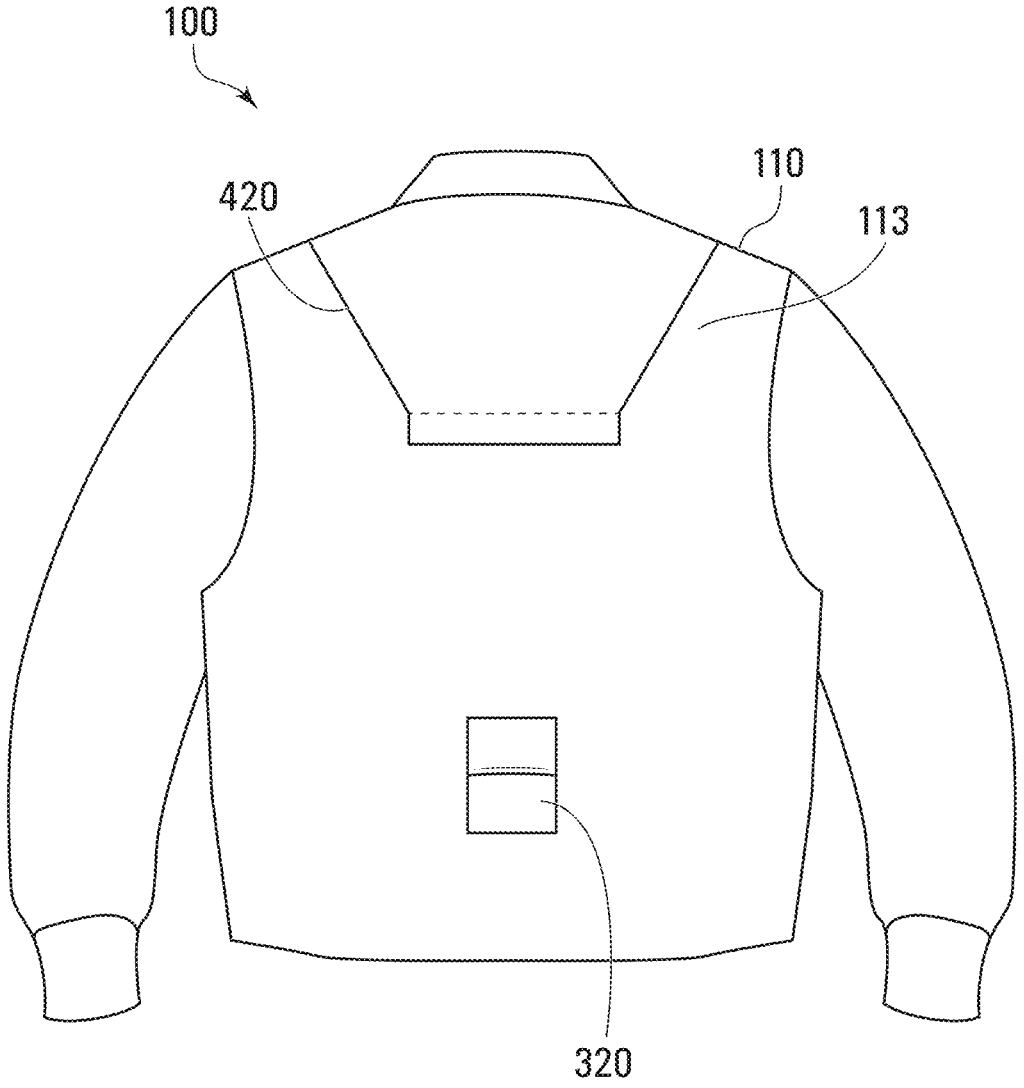
FIG. 2 is a rear view of the garment of FIG. 1.

FIG. 1 illustrates a front view of a garment 100, according to an embodiment, adapted to cover or substantially cover a user's torso and for use with a safety or fall-arrest harness having attachment points such as D-rings. FIG. 2 is a rear view of garment 100.

Garment 100 includes a garment body or a body portion 110 and sleeves 114 coupled to body portion 110. As shown, body portion 110 has at least a front side 112 and a rear side 113. Body portion 110 may also include a front closure 111, such as a zipper or at least one button, extending along front side 112 to facilitate donning and doffing of garment 100. In some embodiments, front closure 111 may be disposed offset or off-center from a vertical midline axis, as shown in FIG. 1, so as to not interfere with accesses as described herein. While illustrated in a right-side configuration, it will be appreciated that front closure 111 can be disposed on either side of a vertical midline axis of garment 100 for right hand or left hand use. In other embodiments, front closure 111 may be centrally disposed along a vertical midline axis.

In some embodiments, pockets 116 are defined in front side 112 on each side of a front closure. Pockets 116 may be selectively opened and closed by fasteners such as zippers, buttons, snaps, or other suitable fastener.

One or more accesses such as a pocket access 120, a front access 220, a rear access 320, and a flap access 420, are also defined in body portion 110 and may be selectively opened and closed to provide access to equipment underneath garment 100.

Accesses allow for a D-ring and/or a portion of the safety harness to pass through layers of garment 100 by way of an opening to the exterior of garment 100 for use.

Garment 100 can include accesses such as one or more pocket accesses 120, one or more front accesses 220, one or more rear accesses 320, and/or a flap access 420 or any combination of accesses as disclosed herein.

In some embodiments, pocket access 120 is adjacent a hand pocket 116, as illustrated in FIG. 1. Pocket access 120 is configured to allow full functionality of hand pocket 116.

In some embodiments, front access 220 is centrally located on front side 112, as illustrated in FIG. 1.

In some embodiments, rear access 320 is centrally located on rear side 113, as illustrated in FIG. 2.

In some embodiments, flap access 420 is disposed on rear side 113, as illustrated in FIG. 2.

Figure 10:
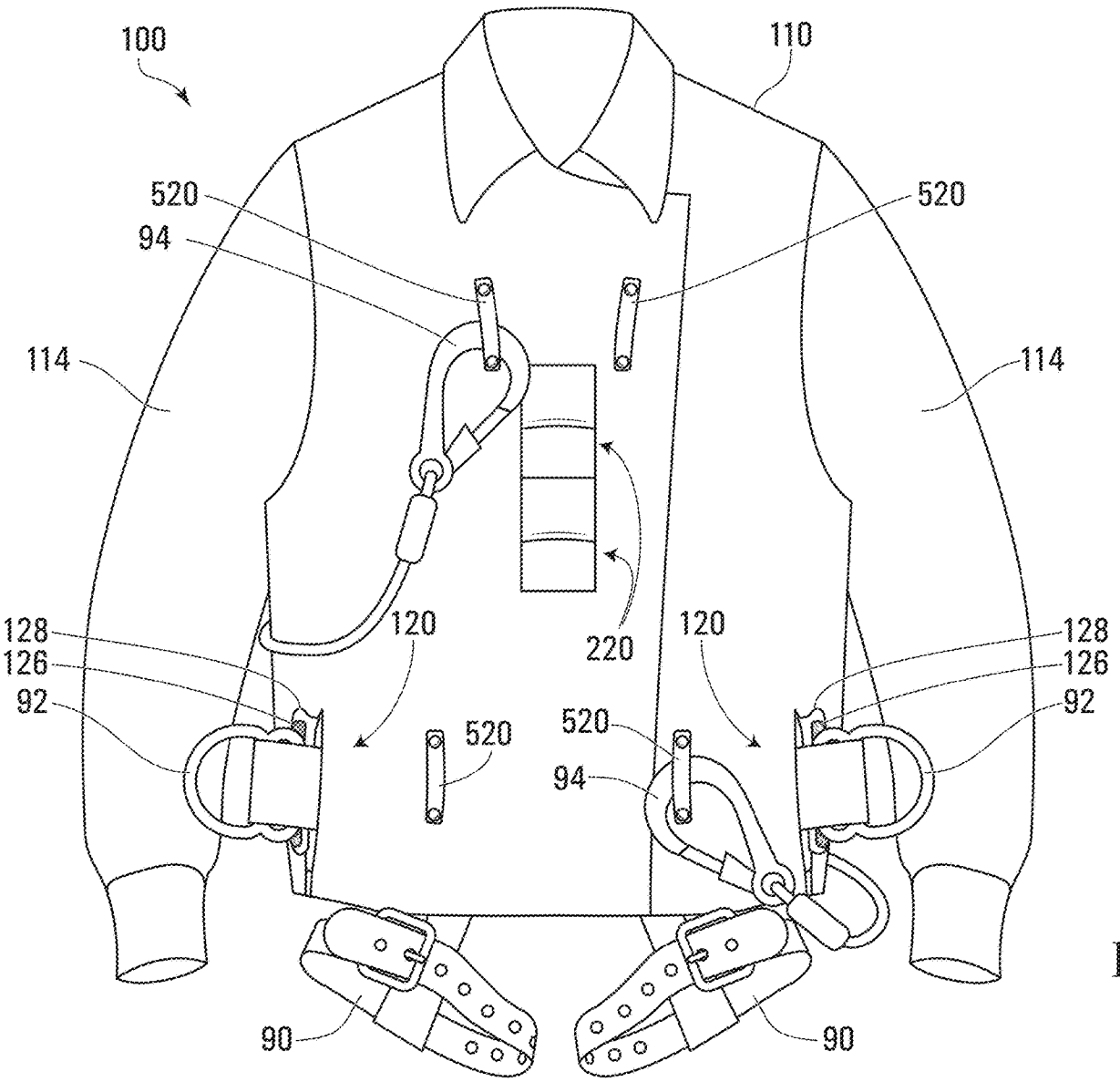
FIG. 10 is another front view of the garment of FIG. 1 in use with a safety harness, according to an embodiment.

In some embodiments, a plurality of hook-receiving members 520 are disposed on the front side 112 of garment body 110. As shown in FIGS. 1 and 10, one pair of the hook-receiving members 520 can be disposed proximal to front closure 111, while another pair of the hook-receiving members 520 can be disposed approximately midway between a vertical midline axis of garment 100 and each side of the outerwear garment body 110 proximal a bottom edge of garment body 110. Hook-receiving members 520 may be formed of loops of fabric secured at distal ends to garment body 110. Hook-receiving members 520 may provide a means for hanging components such as lanyard hooks thereon during periods of non-use to prevent a safety harness from being damaged such as, for example, by being dragged on the ground.

In some embodiments, hook-receiving members 520 are releasably attached to garment body 110, such that upon the application of force, for example, a lanyard caught on something external to garment 100, hook-receiving member 520 releases such that the hooked component (such as a lanyard hook) is no longer retained to garment 100. Thus, the hooked component is released instead of pulling on and displacing garment 100 so that a user's mobility is not restricted, and reducing the risk of garment 100 restraining the user in an unsafe manner. Hook-receiving members 520 can be releasably attached to garment body 110 with a suitable fastener at the distal ends, such as hook and loop or snap fasteners.

While garment 100 is illustrated in FIGS. 1-21 as a jacket, it should be appreciated that garment 100 can also be in the form of a vest, in which case sleeves 114 would be omitted, other garments such as coveralls or overalls, or other top garments such as a pull-over, sweater, sweatshirt, t-shirt or other suitable outerwear garment and may or may not include a front closure such as a zipper, a half zipper, snaps, or other suitable fastener. Furthermore, the positioning and quantity of pockets 116 and accesses such as pocket accesses 120, front accesses 220, 2720, rear accesses 320 can vary significantly (see, e.g., FIGS. 23 and 24 in which accesses are disposed horizontally along a front and proximal to the shoulders, respectively).

The term safety harness as used herein is a harness secured to a wearer to distribute forces over various parts of the wearer's body with means for attaching the harness to anchoring components, for example, to arrest the wearer in a fall from a working level.

Garment 100 can be configured for use with a number of harnesses, including but not limited to fall safety equipment such as Class 1 body belts, Class 2 chest harnesses, Class 3 full body harnesses and Class 4 suspension belts, or other suitable harness.

Figure 3A:
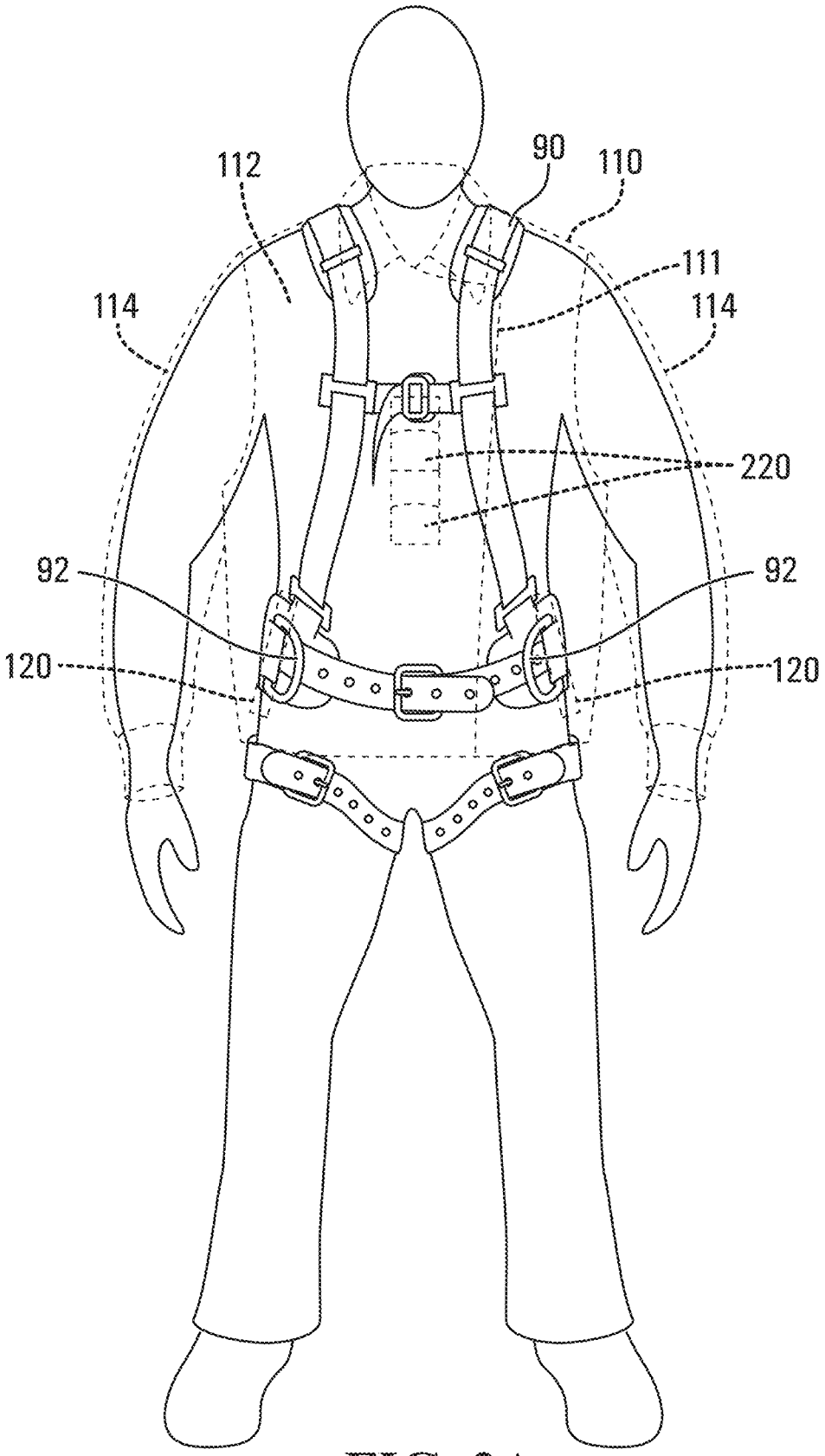
FIGS. 3A and 3B are a front and rear view of the garment of FIG. 1 in use with a safety harness, according to an embodiment.
Figure 3B:
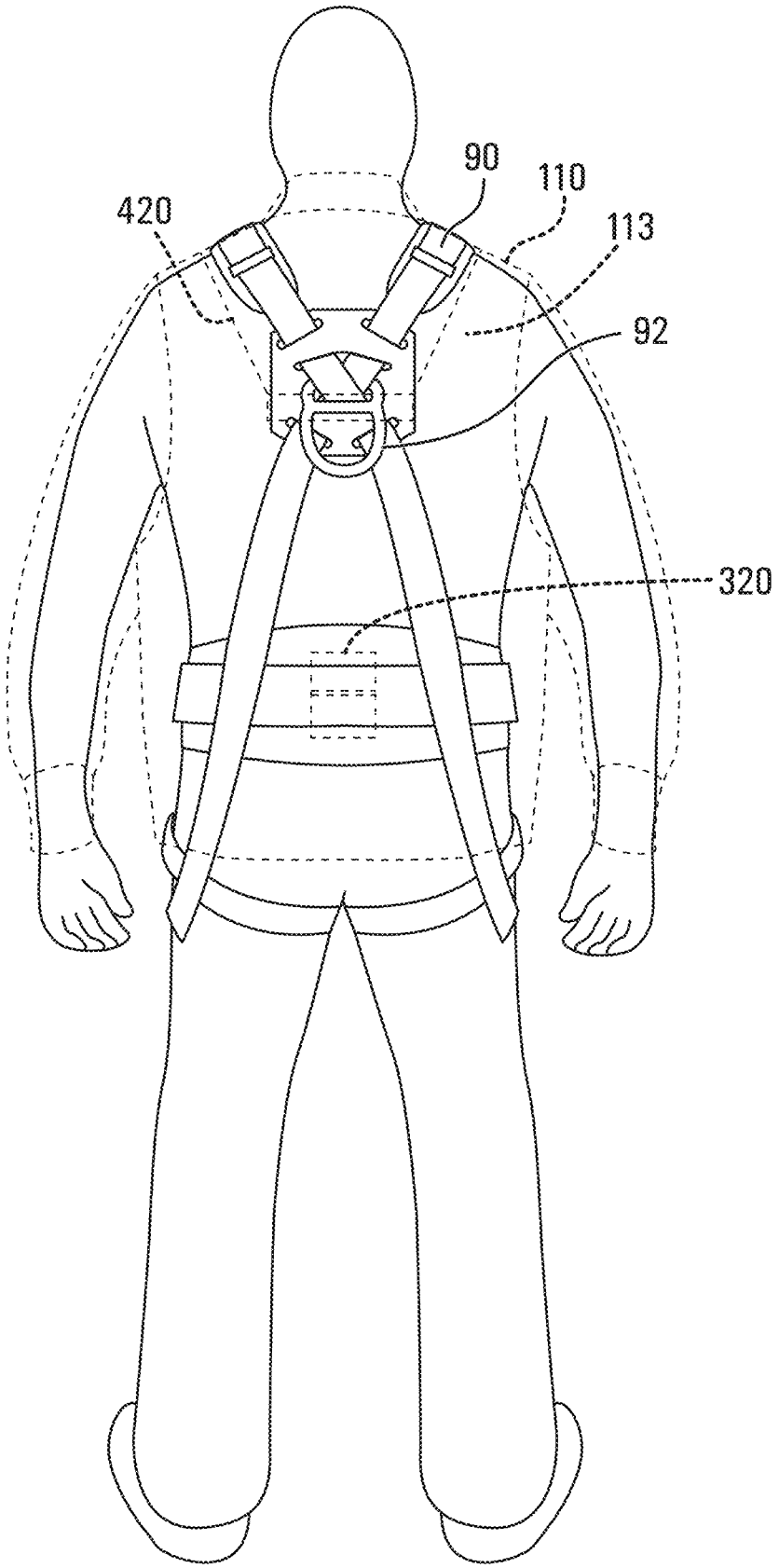

FIGS. 3A and 3B illustrate a front view and a rear view of an example safety harness 90, having one or more attachment points 92, such as D-rings, for use with garment 100. Attachment points 92 such as D-rings can be used to attach to a lanyard, a restraint or fall arrest system, or a work positioning system.

Figure 4A:
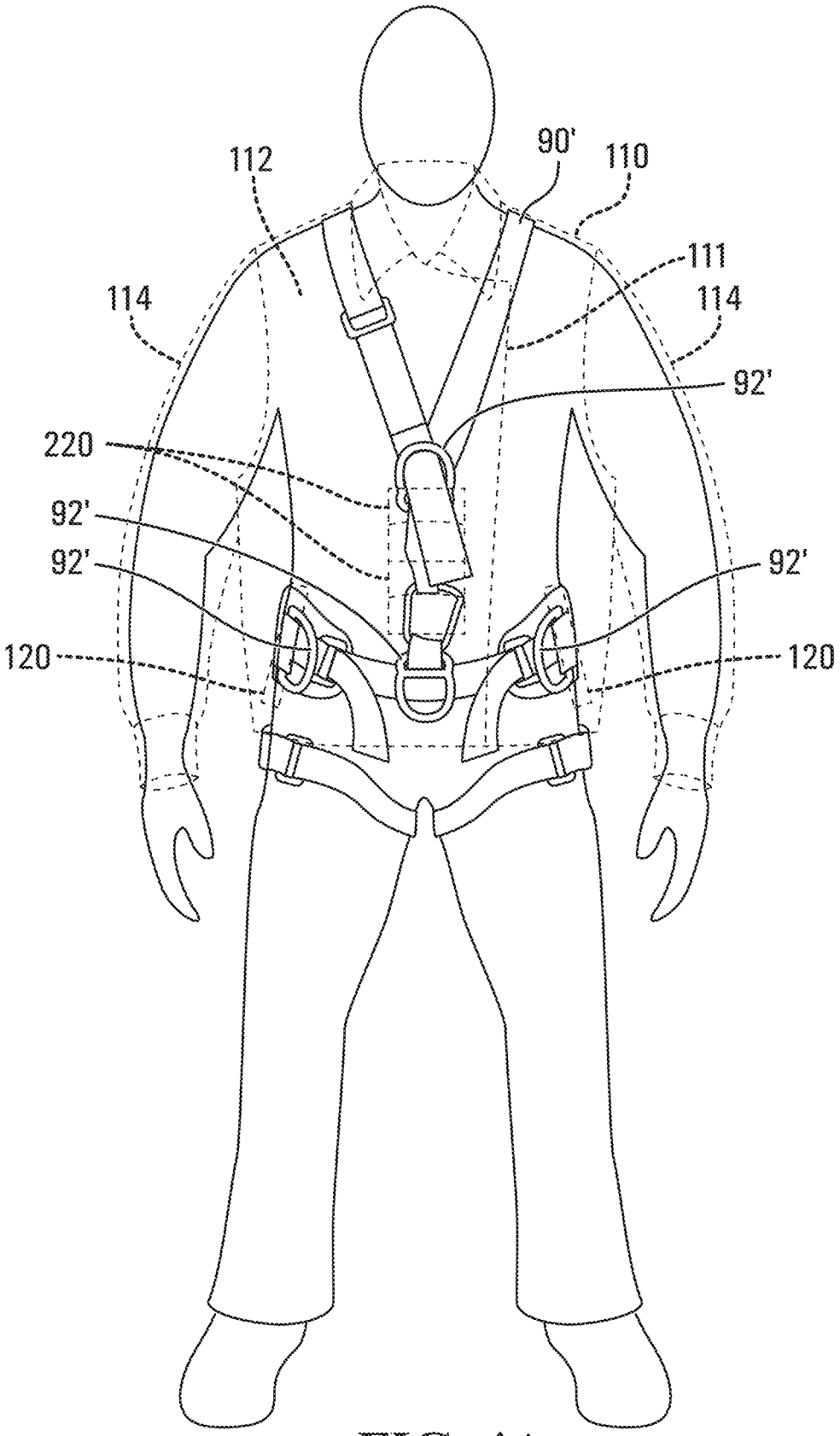
FIGS. 4A and 4B are a front and rear view of the garment of FIG. 1 in use with another safety harness, according to an embodiment.
Figure 4B:
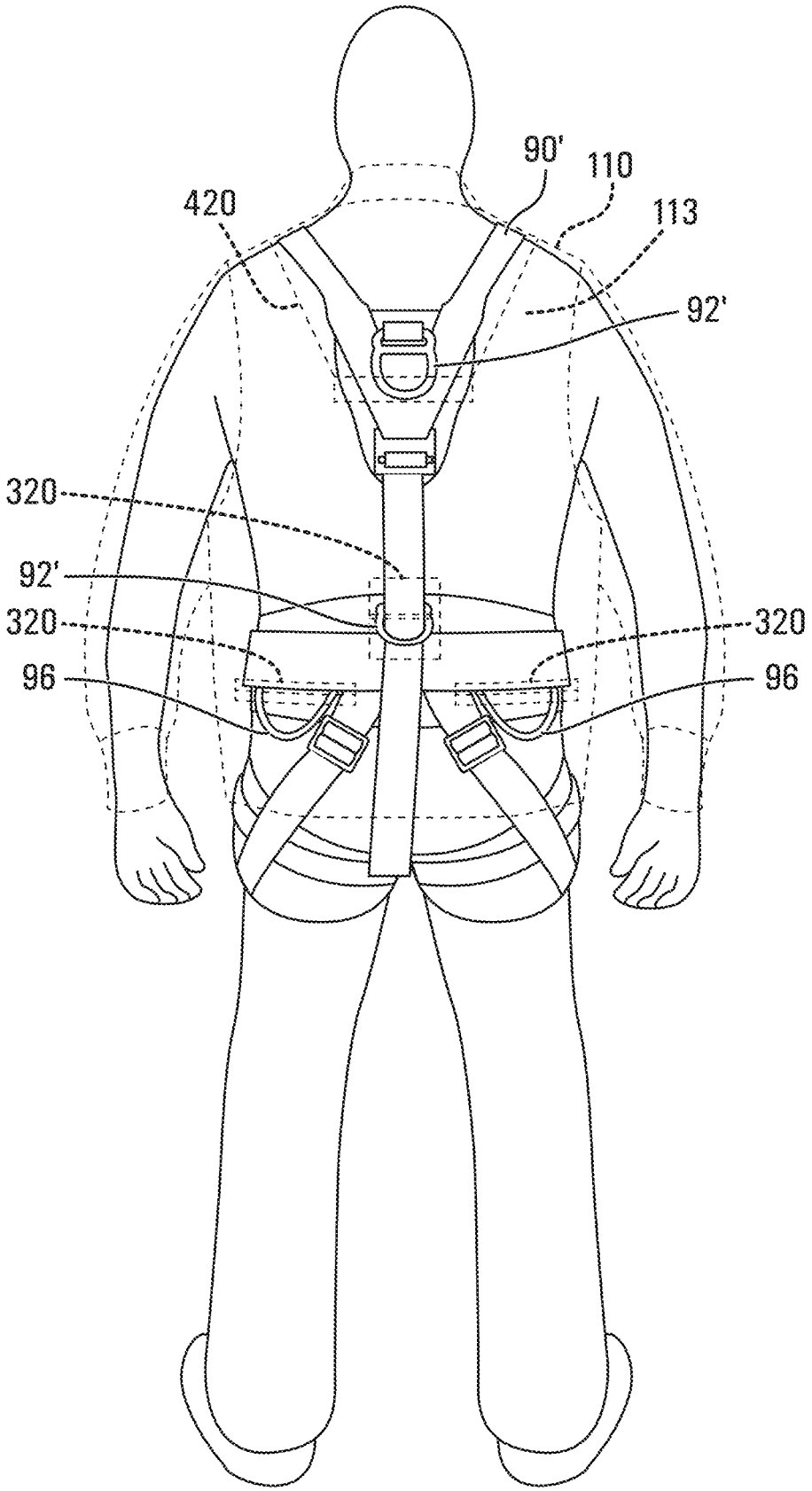

FIGS. 4A and 4B illustrate a front view and a rear view of another example safety harness 90', having one or more attachment points 92', such as D-rings and tool loops or utility loops 96, for use with garment 100. A utility or tool loop such as utility loop 96 can be used to retain an accessory or tool such as a hammer, or to receive components such as ropes, or a lanyard such as lanyard 94 that can be clipped to utility loop 96. In an example, lanyard 94 can be used to secure the user to another user.

Figure 5A:
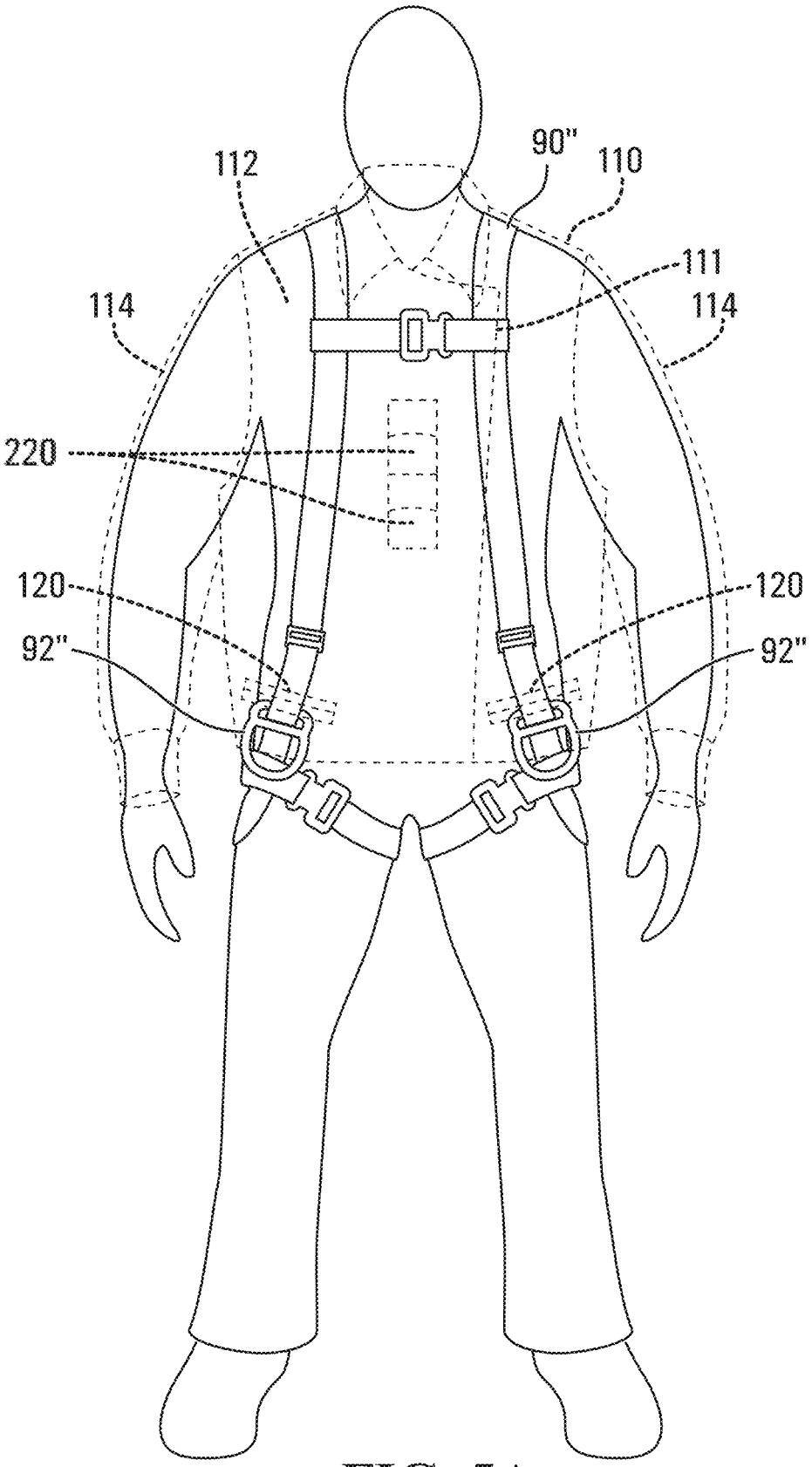
FIGS. 5A and 5B are a front and rear view of the garment of FIG. 1 in use with a further safety harness, according to an embodiment.
Figure 5B:
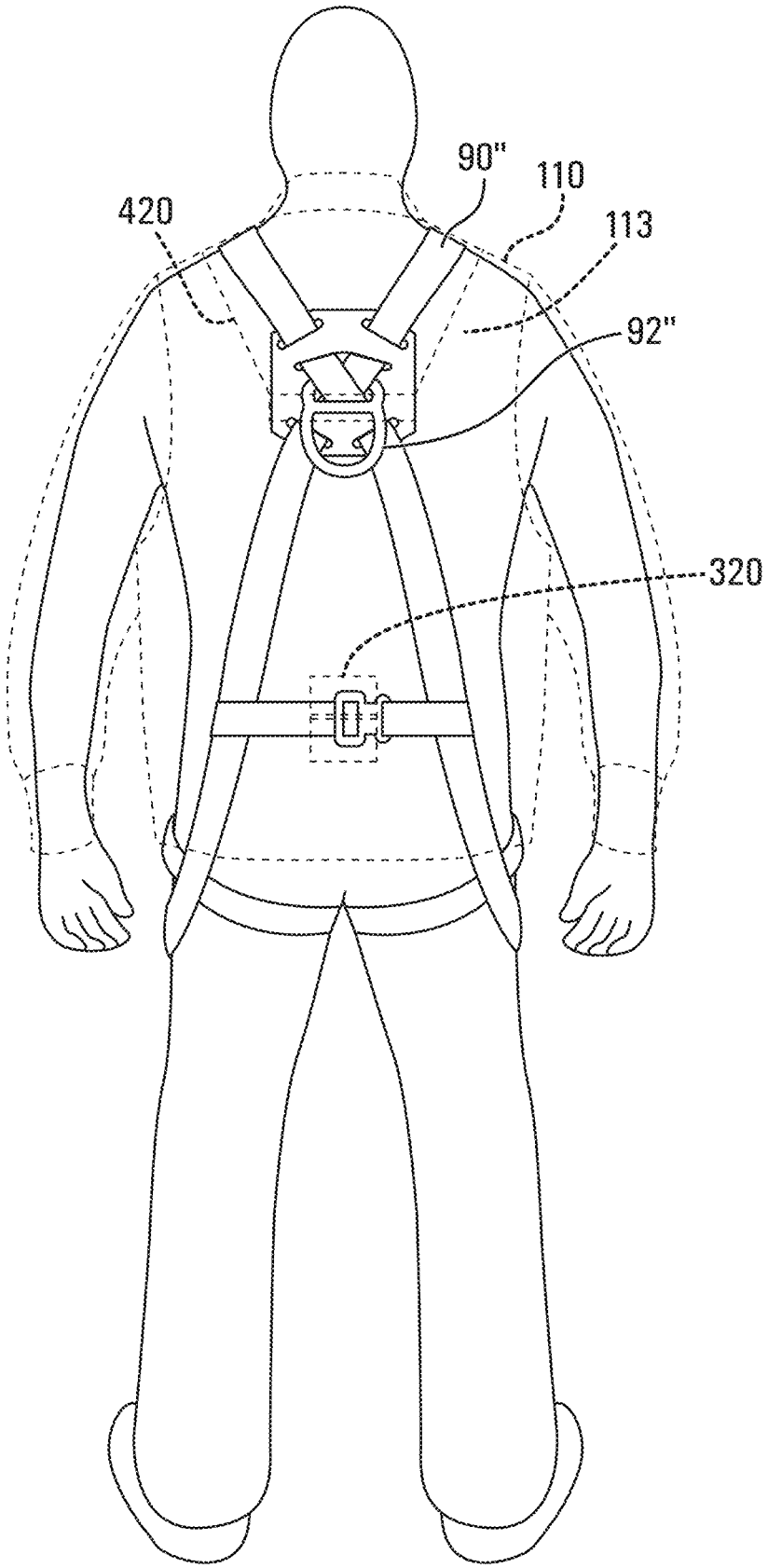

FIGS. 5A and 5B illustrate a front view and a rear view of another example safety harness 90", having one or more attachment points 92", such as D-rings, for use with garment 100.

Accesses, such as pocket access(es) 120, front access(es) 220 and rear access(es) 320, may be disposed on garment 100 such that in use, with garment 100 worn by a user, the accesses are adjacent attachment points on a safety harness that would be worn by the user underneath garment 100.

FIGS. 6-9 illustrate pocket access 120 in more detail.

Pocket access 120 includes an opening 122 defined in body portion 110 adjacent pocket 116. Opening 122 is an aperture having a shape or access area defined in garment body 110, in an example, through a fabric layer of garment 100, and can provide access to equipment such as a safety harness worn by a user underneath garment 100.

Figure 8:
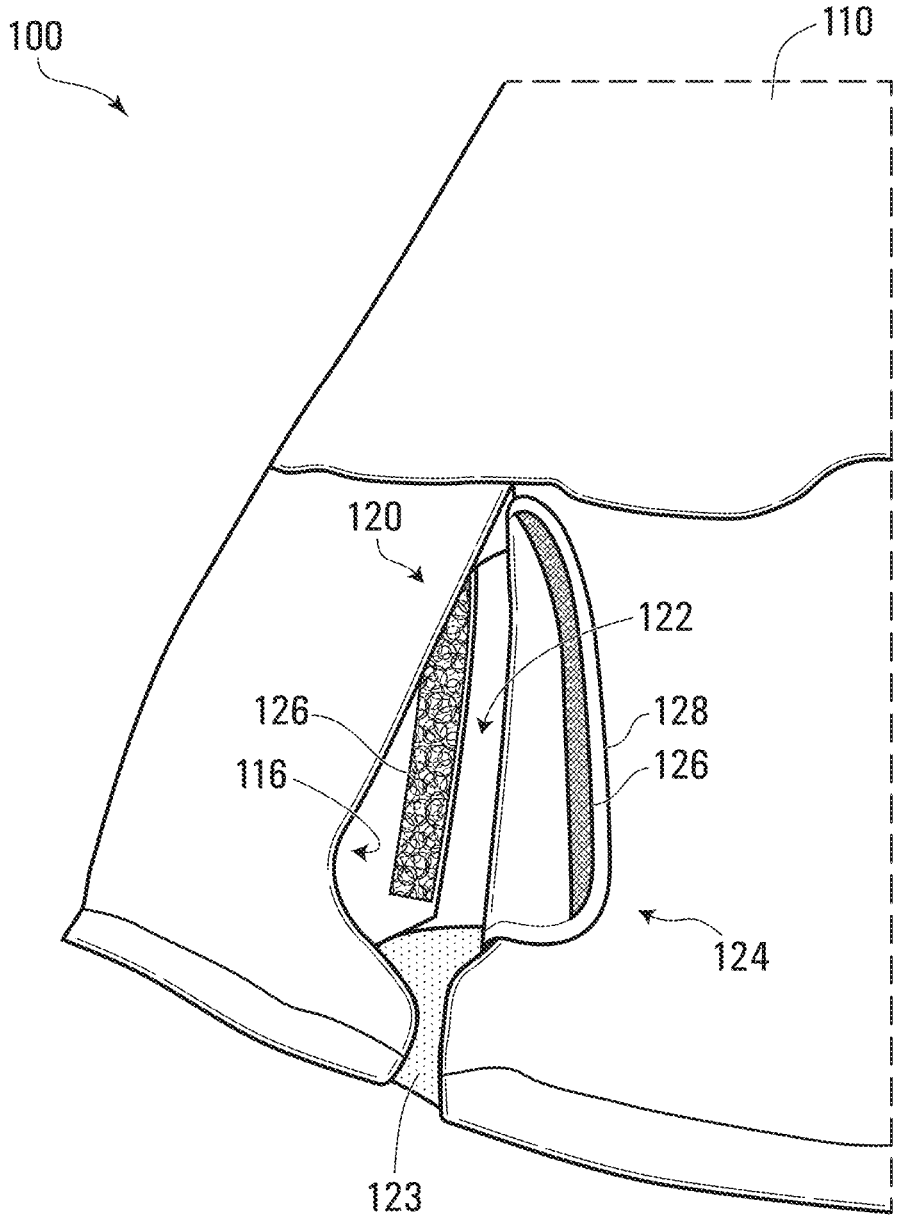
FIG. 8 is a front view of the pocket access of FIG. 6, in an open configuration.

Opening 122 may be adjacent or behind a hand-level pocket such as pocket 116 at a hand-level of the front lower portion of the garment as illustrated in FIG. 8.

While pocket access 120 is illustrated in a generally vertical orientation, with reference to during use, it should be appreciated that pocket access 120, and opening 122, may be oriented at any suitable orientation between vertical and horizontal. In some examples, pocket access 120 is oriented to generally align with an attachment point or D-ring of a safety harness. In an example, as shown in FIG. 5A, pocket access 120 may be oriented generally horizontally.

An opening can be sized suitably to allow a D-ring, tool loop, or desired portion of safety harness to extend therethrough. In some embodiments, opening 122 can extend between three and six inches in length, in an example, five inches in length, generally parallel to an opening of pocket 116.

As best illustrated in FIG. 8, opening 122 is at least partially circumscribed and retained by a flexible portion 123 in body portion 110 of garment 100. In the example illustrated in FIG. 8, opening 122 is retained at an end by a flexible portion 123. Flexible portion 123 can be disposed at any of one or more locations around a boundary of opening 122.

In some embodiments, a flexible portion 123 is disposed at a first end, and a second end opposite the first end of opening 122.

Flexible portion 123 can be formed of a material that is flexible and can bend, and may be extensible such that flexible portion 123 can be extended or stretched.

In some embodiments, flexible portion 123 is formed from an elastic material, such as elasticized fabric.

Figure 9:
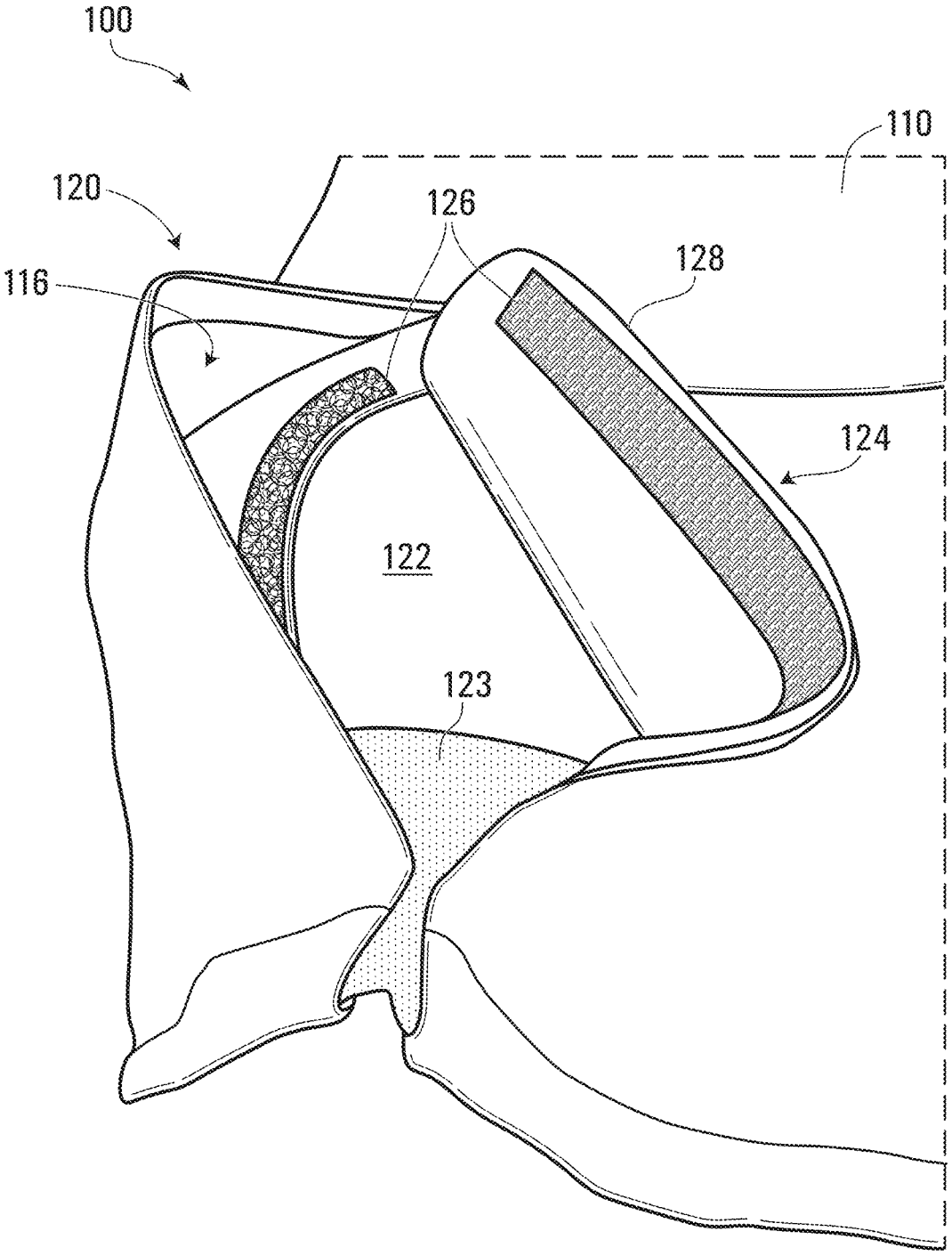
FIG. 9 is a perspective front view of the pocket access of FIG. 6, in an open configuration.

In use, flexible portion 123 can stretch, bend, and flex, allowing the shape of opening 122 to extend and expand, allowing a portion of a safety harness or an attachment point or D-ring to extend through opening 122 without displacing garment 100 or parts thereof, such as body portion 110. FIG. 9 illustrates a perspective front view of pocket access 120, in an open configuration.

Flexible portion 123 may be releasable and can be separable from itself and/or separable from garment 100. In some embodiments, flexible portion 123 can be formed from a releasable material, such as hook and loop, snaps, or a zipper.

Figure 6:
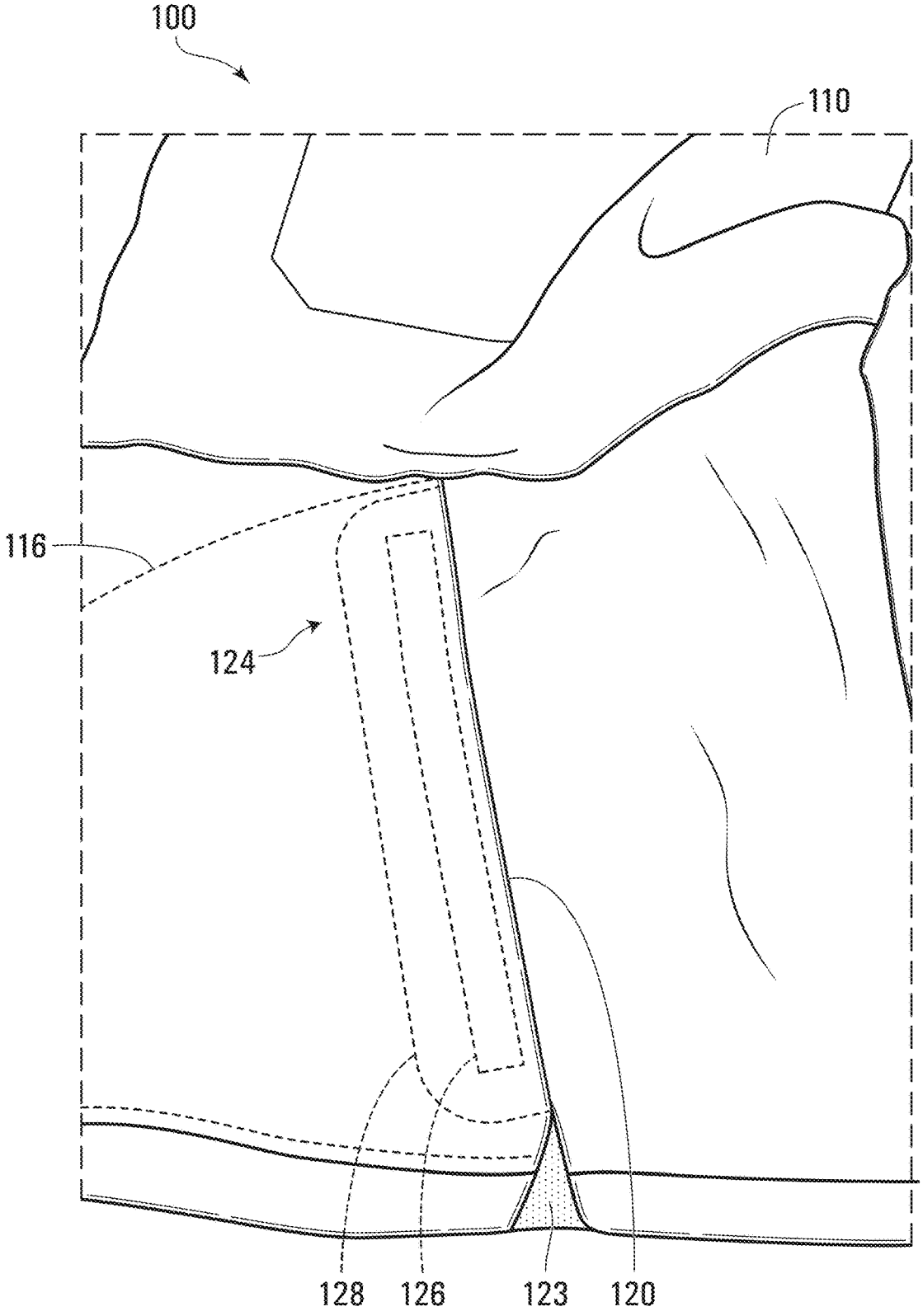
FIG. 6 is an enlarged view of a pocket access of the garment of FIG. 1.
Figure 7:
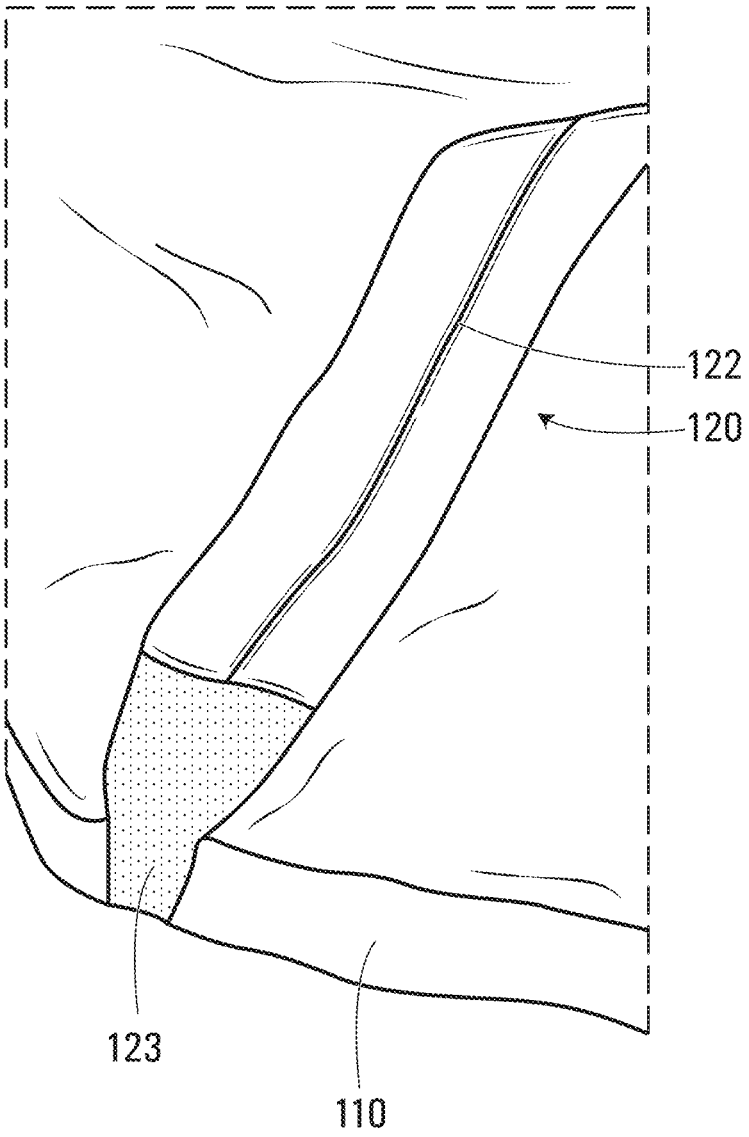
FIG. 7 is rear view of the pocket access of FIG. 6.

Opening 122 is adjustable between a closed configuration, shown in FIGS. 6 and 7, in which a releasable closure 124 covers opening 122, and an open configuration, shown in FIGS. 8 and 9, in which closure 124 has been displaced.

Opening 122 may be selectively opened and closed to control access to safety equipment worn by a user, such as a safety harness, as well as to control air flow through garment 100 and adjust the insulative effect of garment 100.

FIG. 6 illustrates a closed configuration of pocket access 120. FIG. 7 illustrates a closed configuration of pocket access 120 from an interior of garment 100.

In a closed configuration, edges of garment 100 or opening 122 may be in contact with each other, or alternatively, may be coupled in an overlapping fashion.

Pocket access 120 may be utilized in a closed configuration, for example, when a user is not wearing a safety harness, or a when a harness is worn but D-rings are not in use. When pocket access 120 is in a closed configuration, garment 100 may retain its insulating functionality and may prevent elements such as wind, rainwater, snow or the like, from penetrating garment 100 from the exterior of garment 100.

Closure 124 may include a section of material, such as fabric flap 128, to cover opening 122 in a closed configuration. Closure 124 may be disposed to cover opening 122.

In an example, closure 124 includes a fastener 126, disposed on a fabric flap 128, that is attachable to a corresponding fastener 126 disposed in or adjacent the interior of pocket 116, as shown in FIG. 8, to selectively secure opening 122 in a closed configuration. In some embodiments, fastener 126 includes a hook and loop fastener having a hook side and a loop side, one side disposed on fabric flap 128 and the other side disposed at the interior of pocket 116.

In the closed configuration shown in FIGS. 6 and 7, closure 124 is disposed at least partially within hand pocket 116 and is not visible from front side 112 of garment 100 and does not protrude from the surface of front side 112, reducing the risk of being entangled or caught, nor does closure 124 interfere with use of pocket 116, for use as a traditional pocket to hold keys, hands, and the like.

Closure 124 may therefore reside inside the pocket 116 until such time as the wearer desires to open pocket access 120.

Closure 124 may include a variety of fastener or attachment devices, including hook and loop (Velcro), zipper, snaps or tearaway.

In an open configuration, edges of opening 122 are spaced from one another. FIGS. 7 and 8 illustrate an open configuration.

In an open configuration, opening 122 can allow a D-ring and/or a portion of a harness to pass through, for example, for attachment to a lanyard.

Figure 24:
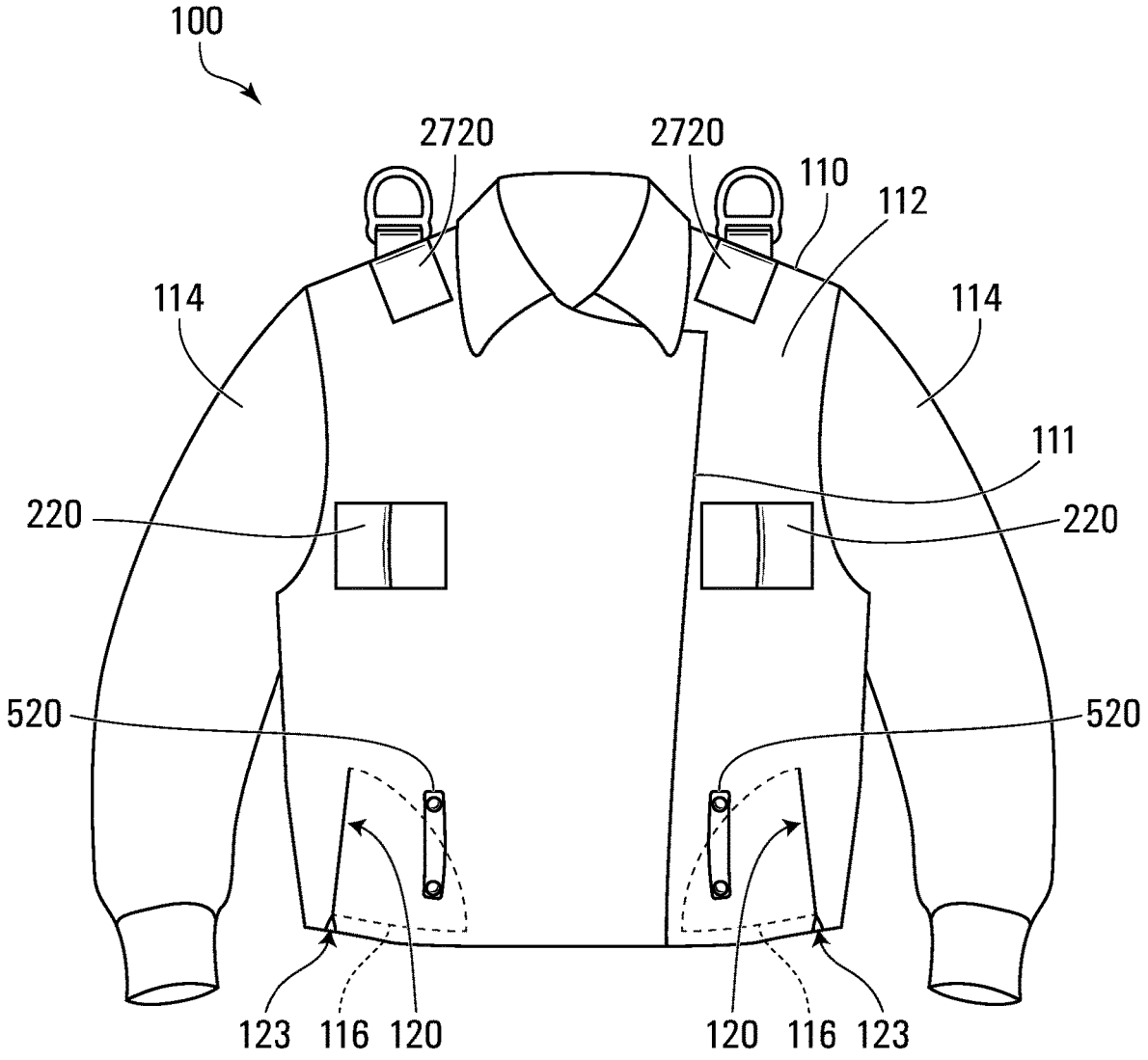
FIG. 24 is a front view of an example embodiment of a garment.

A user wearing garment 100 can therefore adjust pocket access 120 from a closed configuration to an open configuration and reach into opening 122 and grasp a portion of safety harness 90 to pass through opening 122. FIG. 10 illustrates garment 100 and a safety harness 90. FIG. 24 depicts an alternative configuration in which openings/accesses 2720 are present proximal to the shoulders of garment 100, thereby allowing other harness designs to pass through (e.g. for harnesses used for retrieval operations, including but not limited to tanks, manholes, etc. which may be used for confined spaces and may require retrieval from above should an emergency occur).

Figure 11:
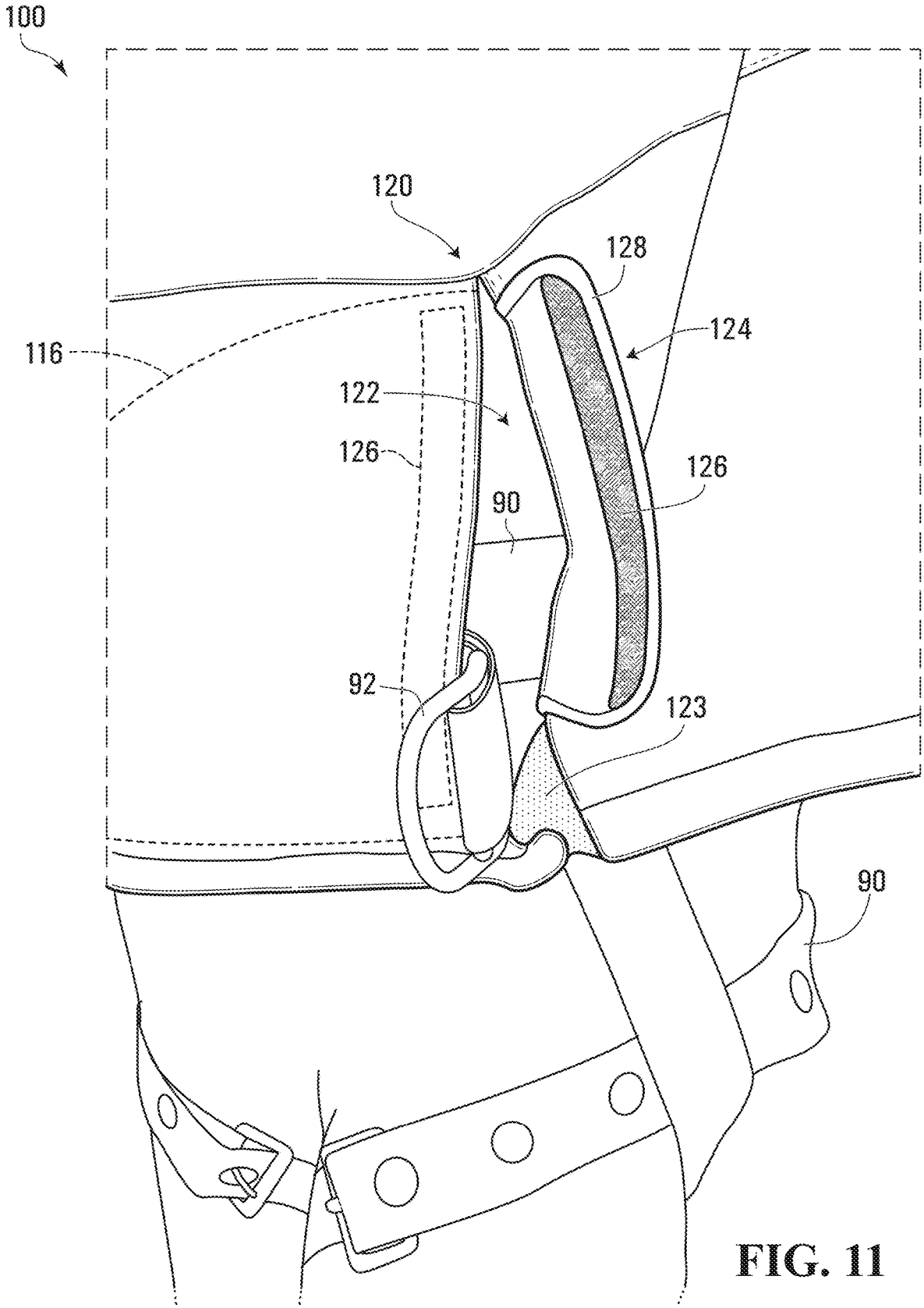
FIG. 11 is an enlarged view of a pocket access of the garment of FIG. 1 in use with a safety harness, according to an embodiment.

In an open configuration, flexible portion 123 may allow for freedom of movement of the garment with respect to the D-ring attachment point 92 and safety harness 90 components passing through opening 122, as shown in FIG. 11. Conveniently, the configuration of opening 122 and flexible portion 123 may prevent garment 100 from restricting a user's mobility and range of motion.

Figure 12:
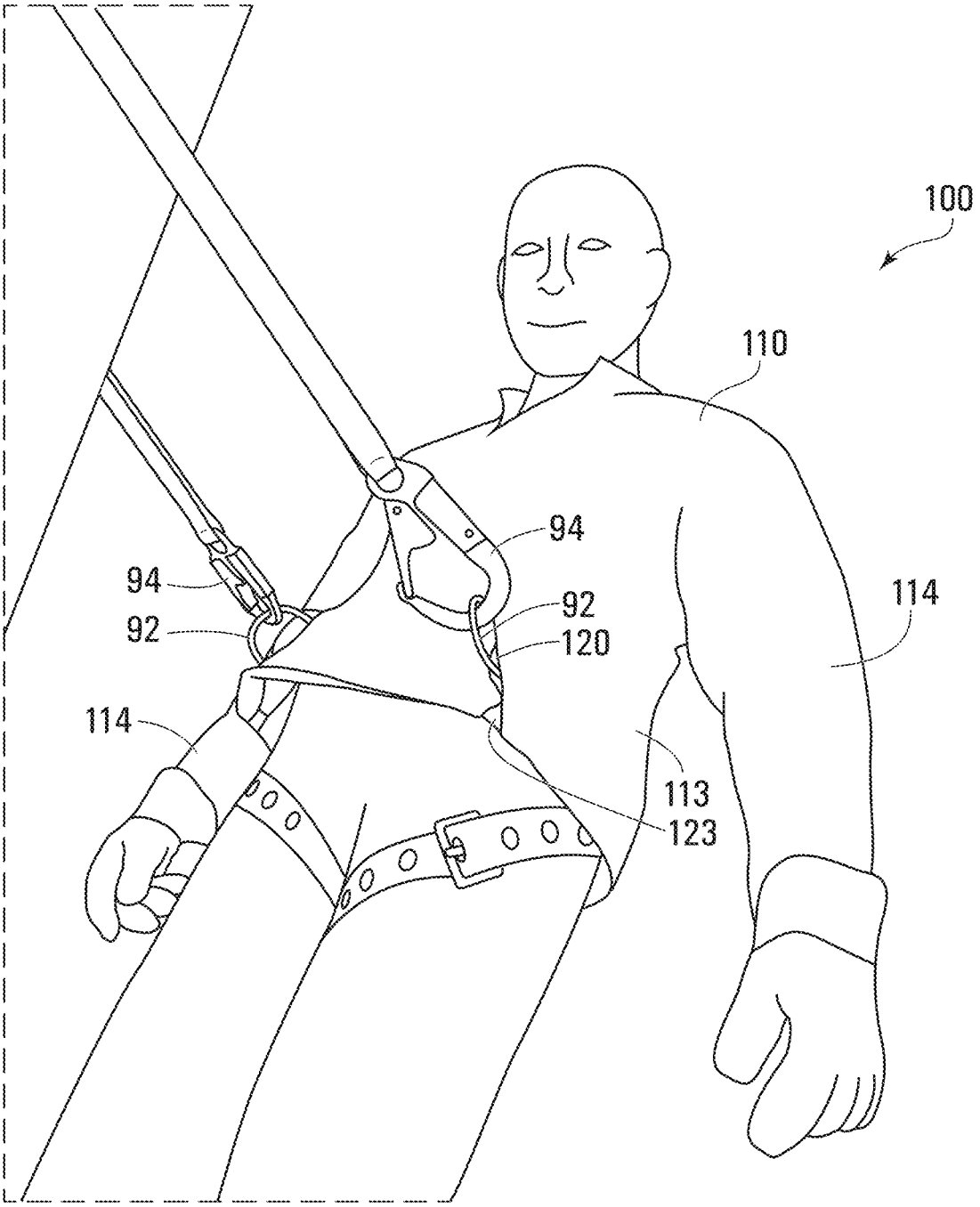
FIG. 12 is a perspective view of the garment of FIG. 1 in use with a safety harness, according to an embodiment.

FIG. 12 illustrates a garment 100 in use with a D-ring attachment points 92 of a safety harness 90 attached to lanyards 94. Openings 122 allow for full accessibility to attachment points 92 while a user is wearing garment 100.

In combination with flexible portion 123, which can provide flexibility and extension to expand and extend opening 122 to accommodate safety harness or a portion thereof to extend therethrough. This can allow body portion of 110 to not be significantly displaced as a safety harness, or a portion thereof, extends through opening 122 for access. A user wearing garment 100 over a safety harness can thus retain flexibility and mobility while in the safety harness.

Returning to FIG. 1, accesses on garment 100 can also include one or more front accesses 220 disposed on front side 112 of body portion 110.

As shown in FIG. 1, in some embodiments, front accesses 220 are centrally disposed along a vertical midline axis of front side 112 and midway between the top and bottom of garment 100, and in some embodiments one front access 220 is sequentially aligned along the central midline axis with another front access 220. It will be appreciated that other configurations for front accesses 220 are contemplated, such as that depicted in FIG. 23, which illustrates front accesses 220 being oriented substantially horizontally. The configuration depicted in FIG. 23 may be useful in combination with personal suspension systems, which are widely used in window washing and painting industries (as they may allow for a worker to be supported while allowing a hands-free work environment). Accesses 220 in FIG. 23 may be, for example, sneaky flaps which allow a harness D-ring to pass therethrough with a substantially horizontal orientation.

Front access 220 can be sized suitably to allow a D-ring or desired portion of safety harness to extend therethrough. In an example, front access 220 can extend between three inches and six inches in length, such as three inches in length, generally horizontally.

Figure 13A:
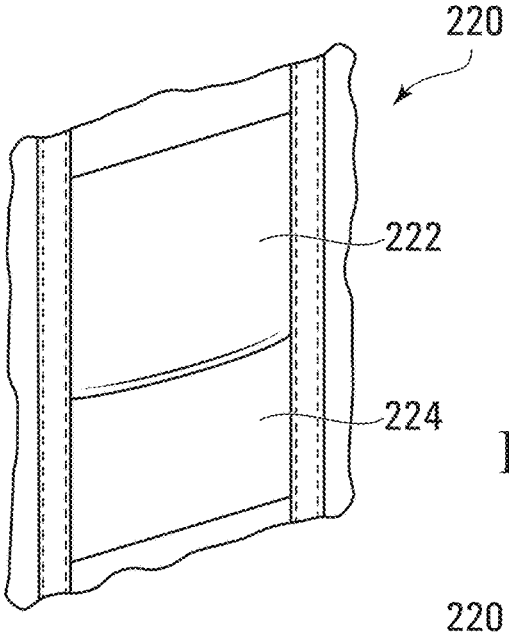
FIGS. 13A to 13C are front perspective views of embodiments of a front access of the garment of FIG. 1, according to embodiments.
Figure 13B:
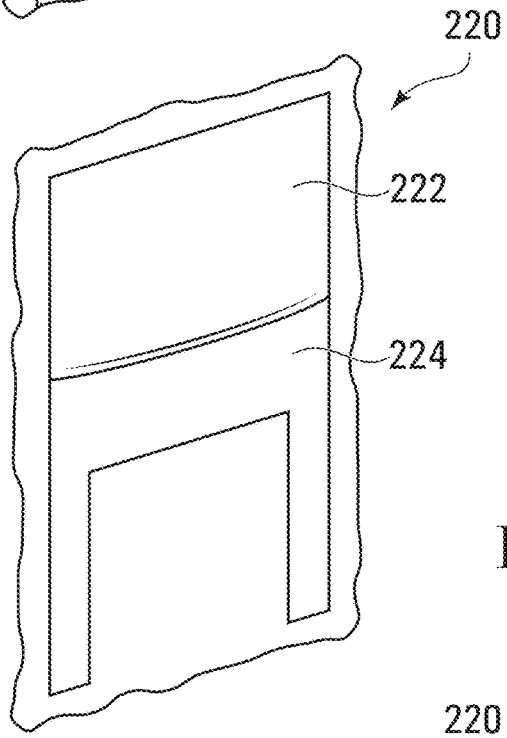
Figure 13C:
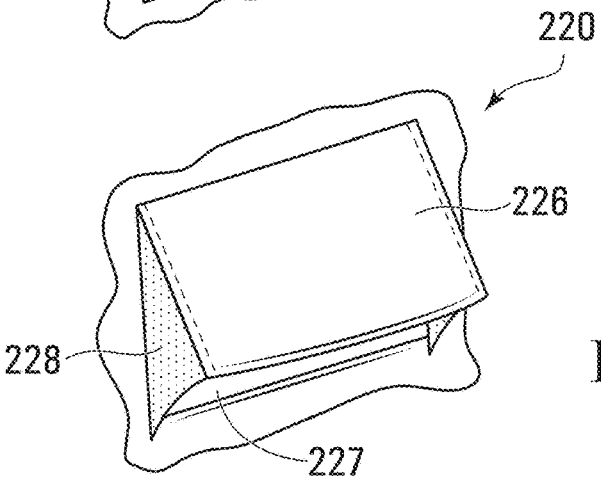

FIGS. 13A to 13C are front perspective views of embodiments of a front access of garment 100.

As shown in FIG. 13A, a front access 220 can include a first portion 222 and a second portion 224 disposed in garment 100. First portion 222 is located to at least partially overlap second portion 224, which may allow garment 100 to retain its insulating functionality and prevent elements such as wind, rainwater, snow or the like, from penetrating garment 100 from the exterior of garment 100.

First portion 222 and second portion 224 can be formed from a flexible material, such as elasticized fabric or other material with suitable flexible and extensible properties.

Figure 23:
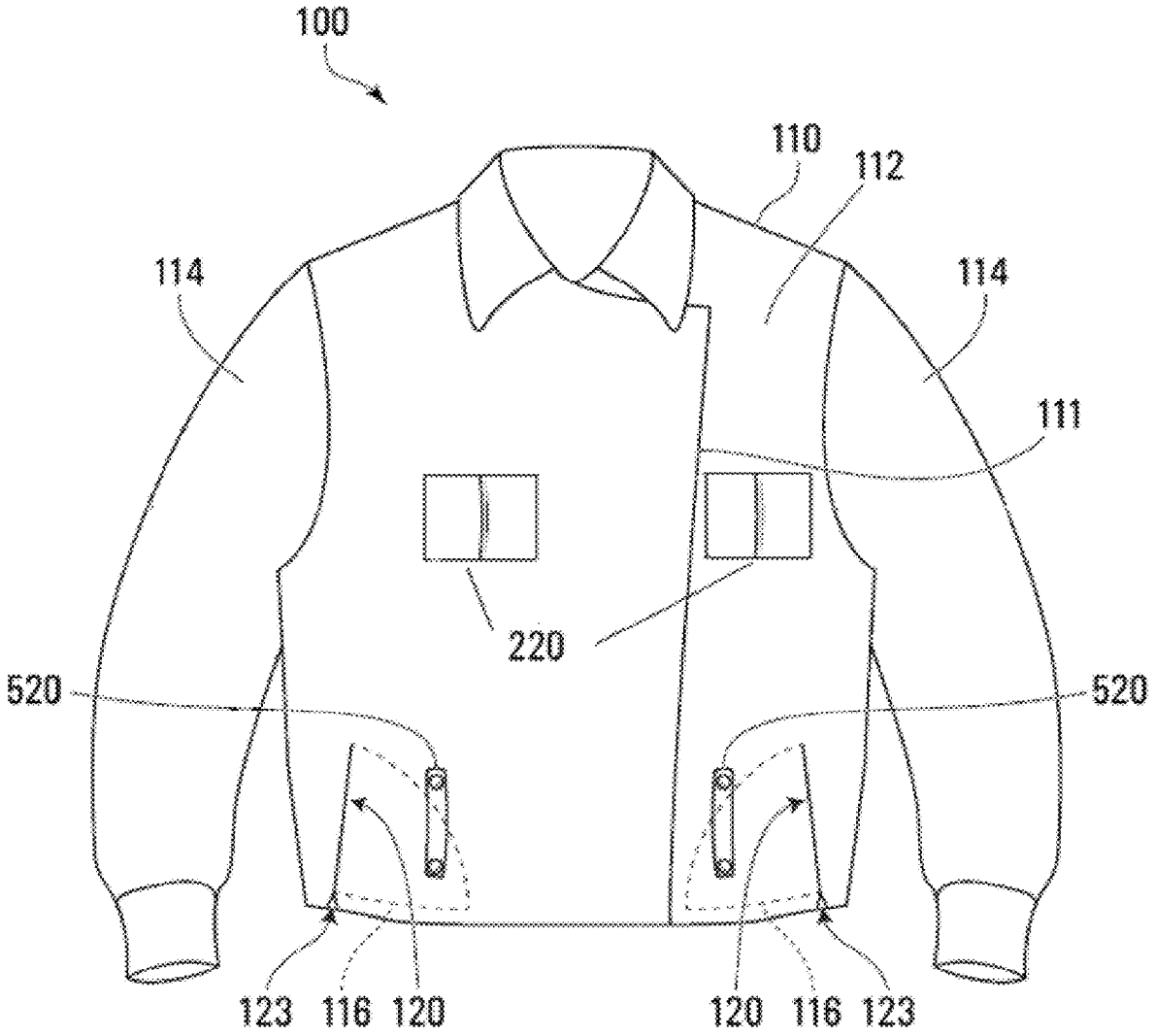
FIG. 23 is a front view of an example embodiment of a garment.

While front access 220 is illustrated in a generally horizontal orientation, with reference to during use, it should be appreciated that front access 220 may be oriented at any suitable orientation between vertical and horizontal (see, for example, FIGS. 23 and 24). In some examples, front access 220 is oriented to generally align with an attachment point or D-ring of a safety harness.

FIG. 13B is a front perspective view of an embodiment of front access 220 with second portion 224 having flexible projections extending downwardly.

FIG. 13C is a front perspective view of an embodiment of front access 220 having a fabric flap 226.

In some embodiments, front access 220 can include a fabric flap 226 covering an aperture 227 defined in body portion 110 of garment 100. Fabric flap 226 is coupled to body portion 110 with elasticized flexible portions 228 that allow fabric flap 226 to move between a closed configuration and an open configuration.

Fabric flap 226 can also be secured in a closed configuration with attachment 229 such as snaps, hook and loop fasteners, or other suitable fastener.

Figure 14:
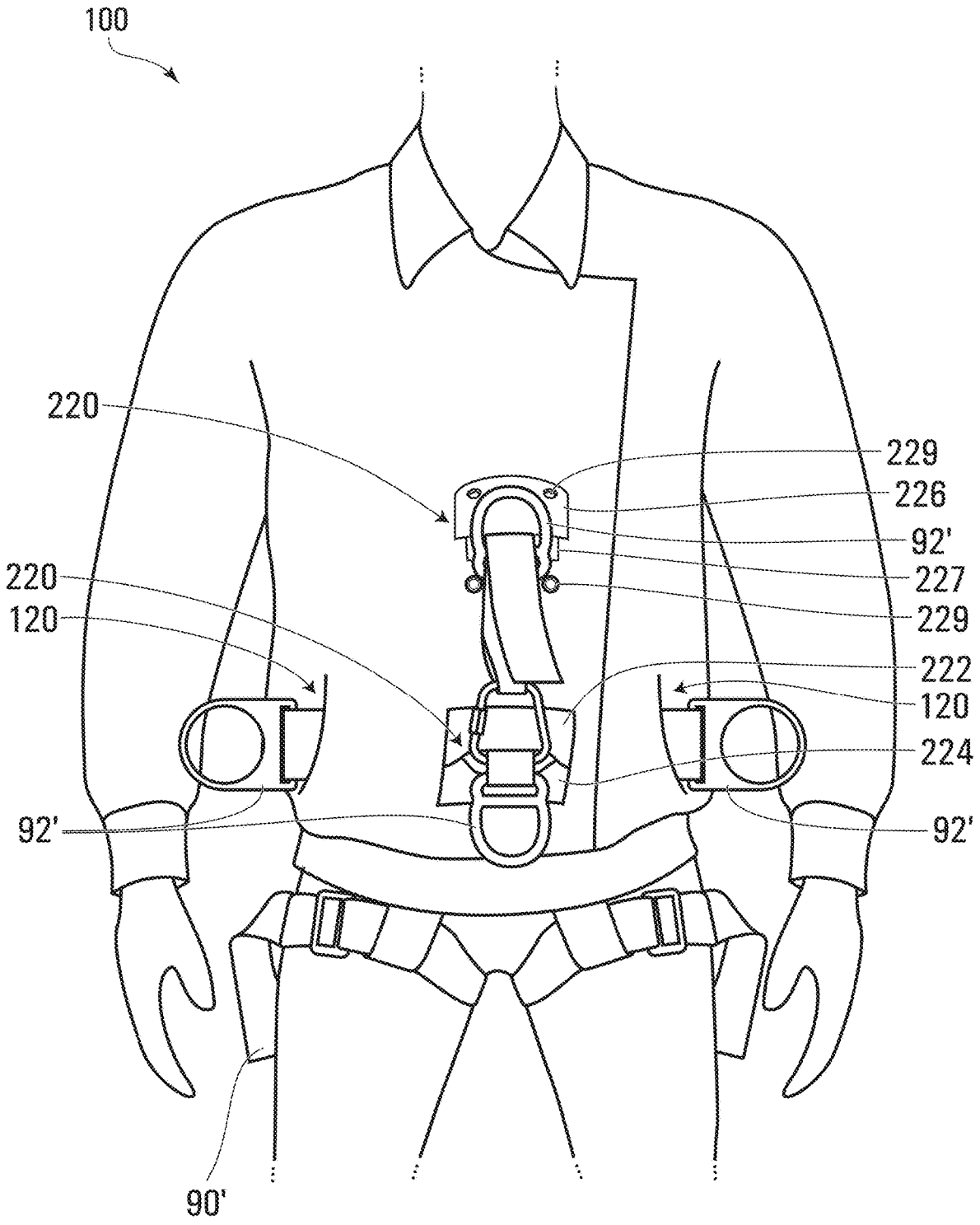
FIG. 14 is a front view of front accesses with a safety harness, according to an embodiment.

FIG. 14 is a front view of front accesses 220, in use, according to an embodiment.

FIG. 14 illustrates two front accesses 220 used together, with components of safety harness 92' extending therethrough. First portion 222 and/or second portion 224 can stretch, bend, and flex to define an opening through which a portion of a safety harness can extend through. A user wearing garment 100 can therefore reach between first portion 222 and second portion 224 and grasp a portion of a safety harness to pass through the opening of garment 100. Thus, components of a safety harness are accessible to a user without having to take off garment 100. It will be appreciated that similar operational principles may apply to configurations depicted in FIGS. 23 and 24 in relation to a safety harness and components associated therewith being able to pass through accesses 220, 2720.

Figure 15:
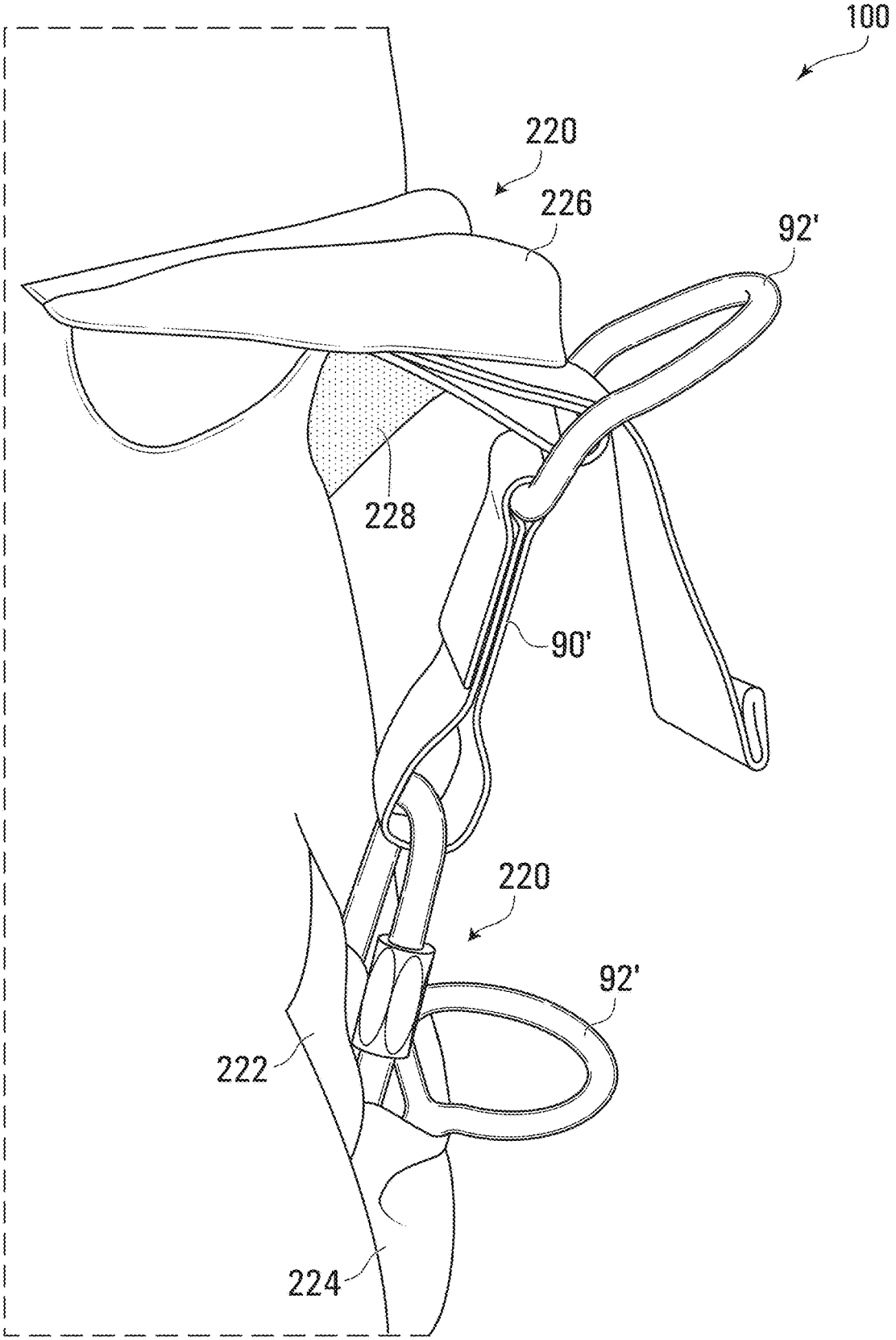
FIG. 15 is a side view of the front accesses and the safety harness of FIG. 14.

As shown in FIGS. 14 and 15, in an example, a rescue harness such as safety harness 90' can include a top D-ring and a bottom D-ring as front attachment points. the top D-ring can extend through a first front access 220, and the bottom D-ring can extend through a second front access 220, and the top D-ring and bottom D-ring can then be attached to each other, for example, with a carabiner.

Figure 16:
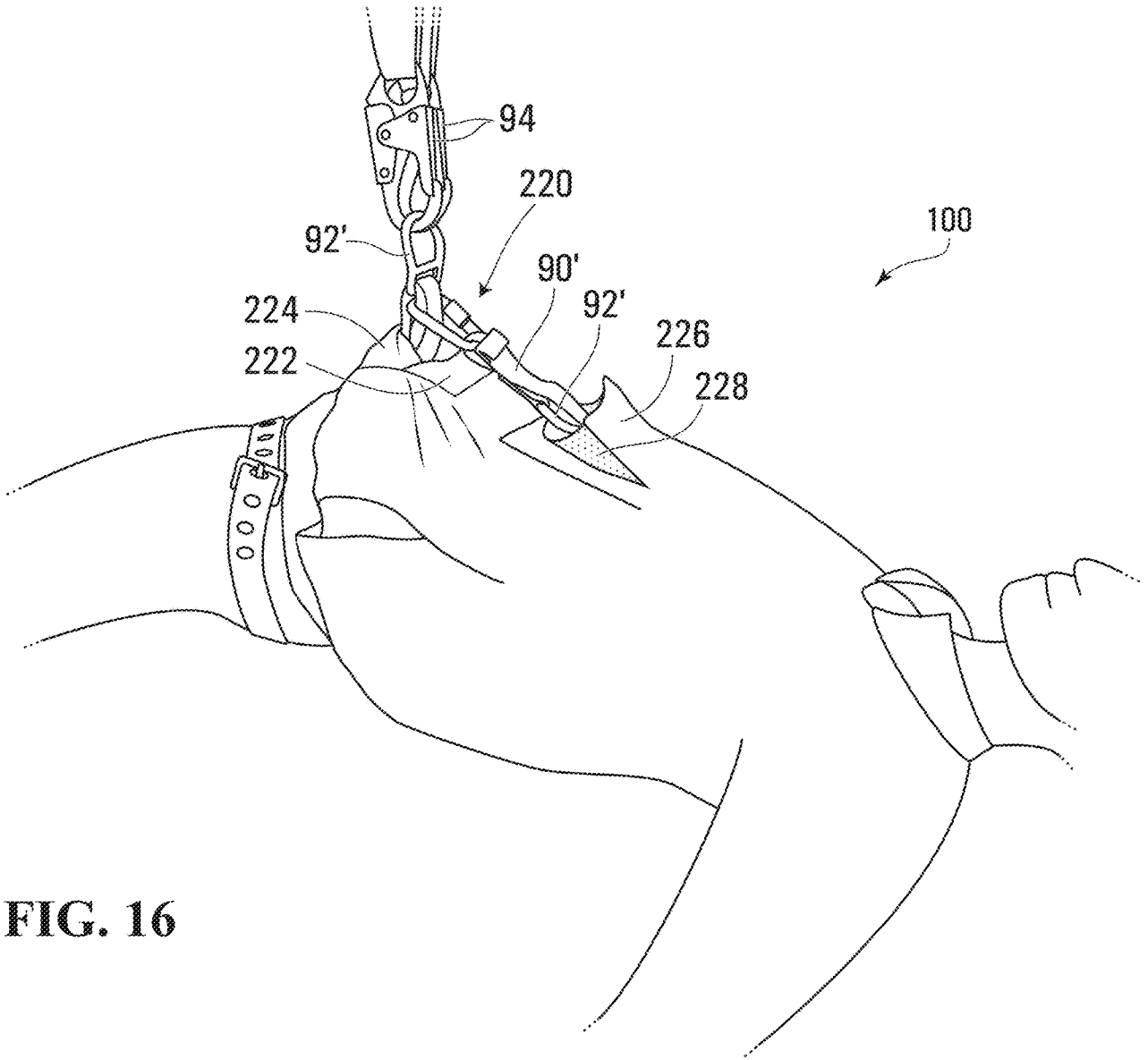
FIG. 16 is a side perspective view of the front accesses and the safety harness of FIG. 14, with an attachment point in use, according to an embodiment.
Figure 17:
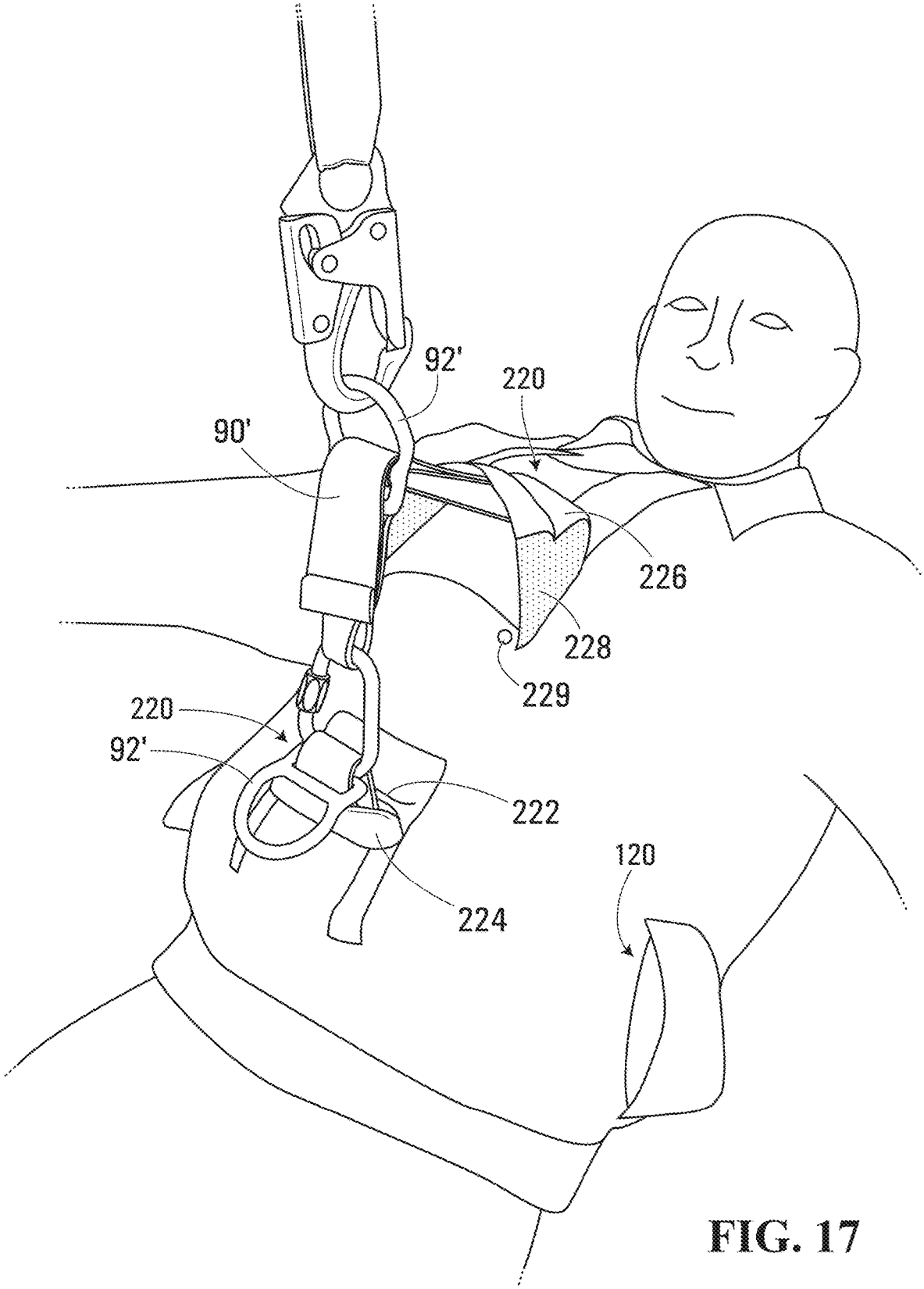
FIG. 17 is a front perspective view of the front accesses and the safety harness of FIG. 14, with another attachment point in use, according to an embodiment.
Figure 18:
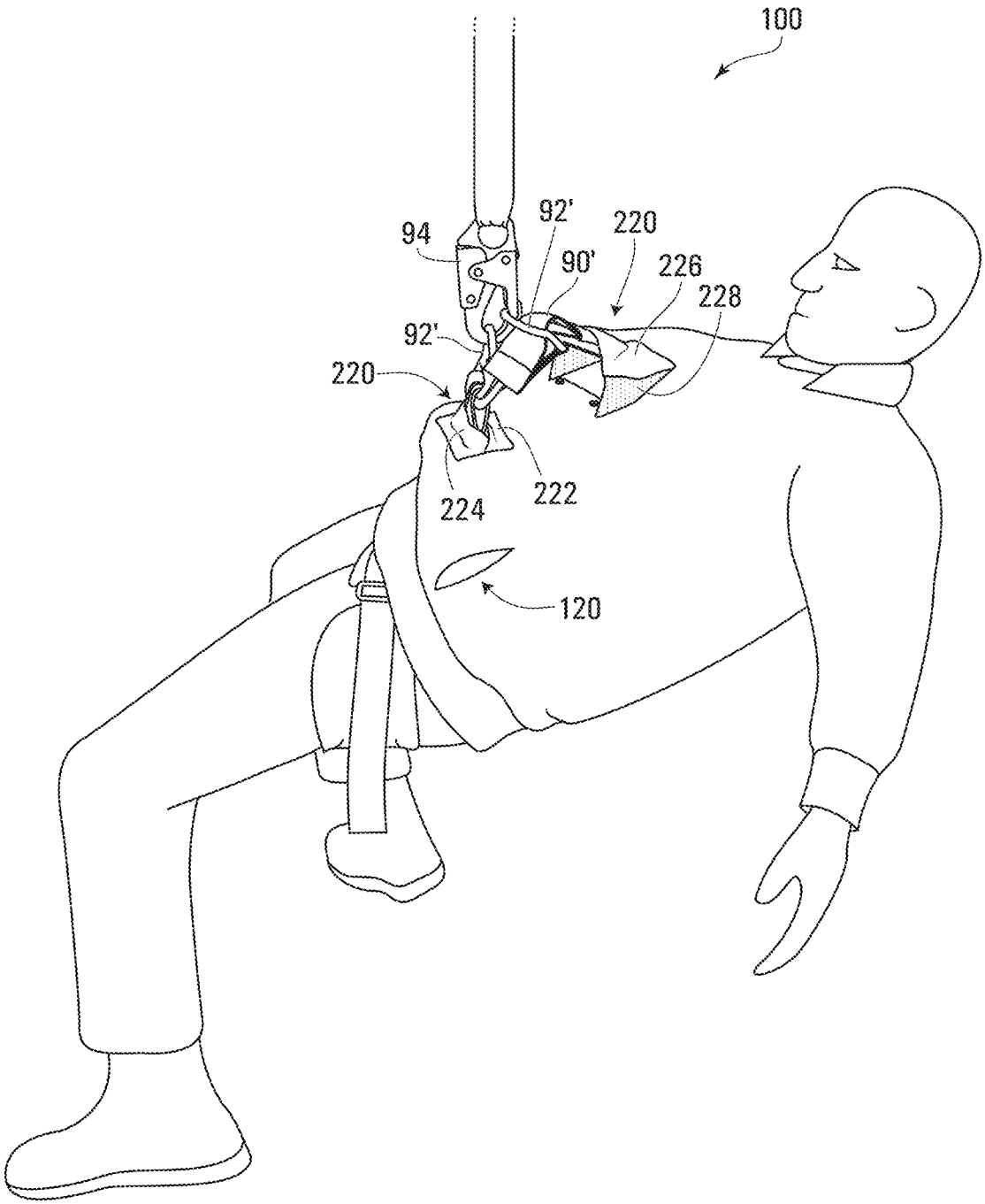
FIG. 18 is a side perspective view of the front accesses and the safety harness of FIG. 14, with two attachments points in use, according to an embodiment.

FIGS. 16-18 show front accesses 220 in use by a user with safety harness 90' extending through front accesses 220 and attachment points 92' in use, without displacing garment 100 or potentially causing garment 100 to restrain the user, and allowing the user to have full flexibility and mobility.

Turning to FIG. 2, accesses on garment 100 can also include one or more rear accesses 320 disposed on rear side 113 of body portion 110. Rear access 320 may be similar in structure and components to front access 220, differing in being located on rear side 113 instead of front side 112.

As shown in FIG. 2, in some embodiments, a rear access 320 can be centrally disposed along a vertical midline axis of rear side 113 and between the top and bottom of garment 100. In some embodiments, rear access 320 can be disposed midway between the top and bottom of garment 100, in a top half of garment 100 adjacent the top of garment 100, or in a bottom half of garment 100 adjacent the bottom of garment 100. In some embodiments a rear access 320 is sequentially aligned along the central midline axis with another rear access 320.

Figure 19:
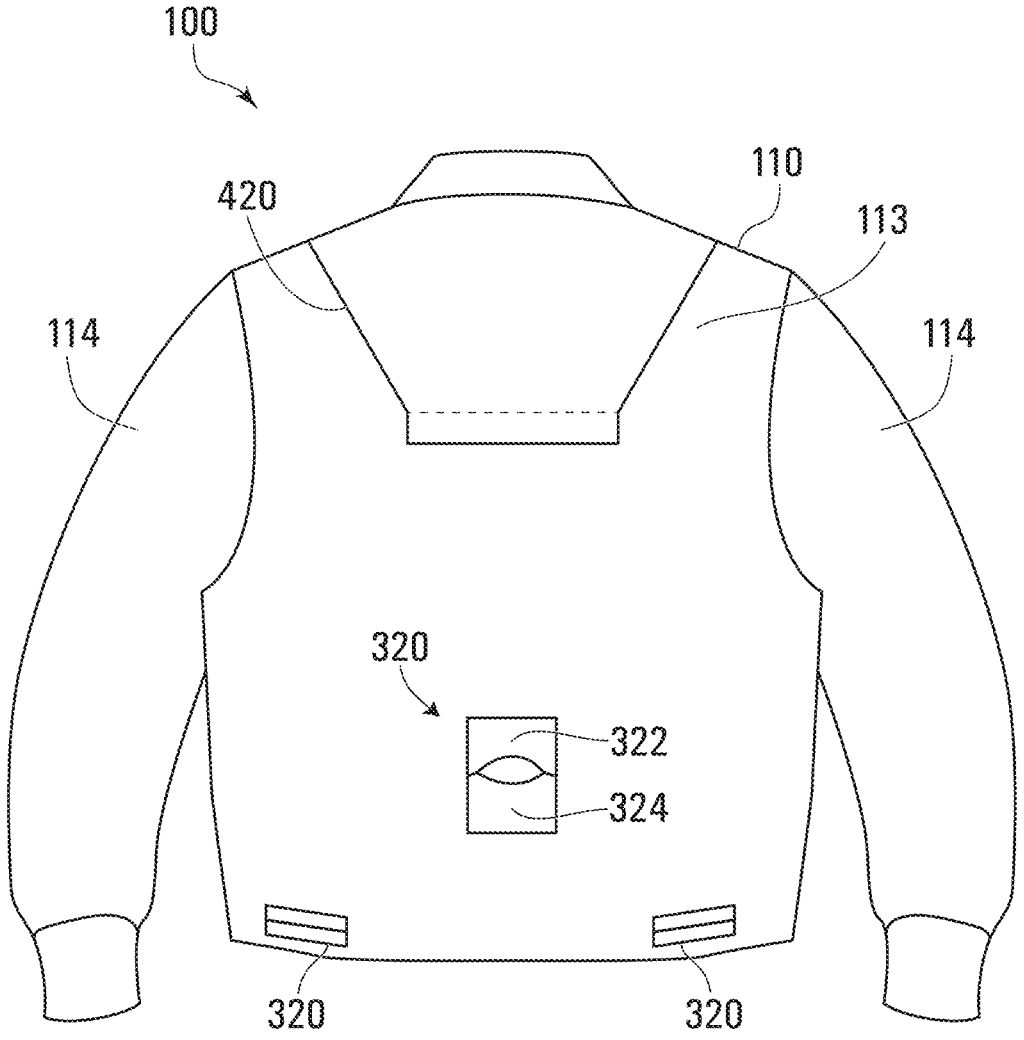
FIG. 19 is a rear view of the garment of FIG. 1, with a rear access in an open configuration, according to an embodiment.

In some embodiments, rear access 320 can be located adjacent a bottom edge of rear side 113, such as a side hip location in use, and can allow access to a utility loop, such as utility loop 96 as shown in FIGS. 4B and 19, on a safety harness at a user's hip level.

Rear access 320 can be sized suitably to allow a D-ring or desired portion of safety harness to extend therethrough. In an example, rear access 320 can extend between three inches and six inches, such as three inches, in length generally horizontally.

FIG. 19 is a rear view of a garment 100 including a rear access 320, in an embodiment.

As shown in FIG. 19, rear access 320 can include a first portion 322 and a second portion 324 disposed in garment 100. First portion 322 is located to at least partially overlap second portion 324, which may allow garment 100 to retain its insulating functionality and prevent elements such as wind, rainwater, snow or the like, from penetrating garment 100 from the exterior of garment 100.

First portion 322 and second portion 324 can be formed from a flexible material, such as elasticized fabric or other material with suitable flexible and extensible properties.

While rear access 320 is illustrated in a generally horizontal orientation, with reference to during use, it should be appreciated that rear access 320 may be oriented at any suitable orientation between vertical and horizontal. In some examples, rear access 320 is oriented to generally align with an attachment point or D-ring of a safety harness.

In some embodiments, second portion 324 includes flexible projections extending downwardly.

In some embodiments, rear access 320 can include a fabric flap covering an aperture defined in body portion 110 of garment 100. The fabric flap can be coupled to body portion 110 with elasticized flexible portions that allow the fabric flap to move between a closed configuration and an open configuration. The fabric flap can also be secured in a closed configuration with attachment such as snaps.

Figure 20:
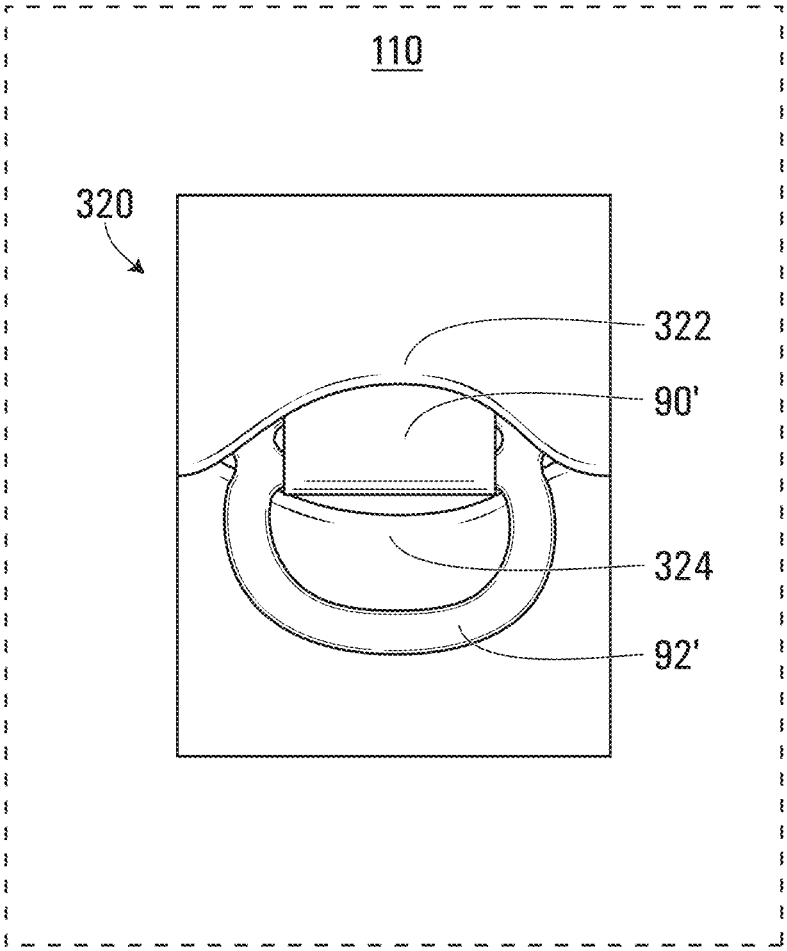
FIG. 20 is an enlarged view of the rear access of FIG. 19 with a safety harness, according to an embodiment.

FIG. 20 illustrates rear access 320, in use with safety harness 90' extending therethrough, according to an embodiment.

As shown in FIG. 20, first portion 322 and/or second portion 324 can stretch or extend to define an opening through which a portion of a safety harness can extend through. A user wearing garment 100 can therefore reach between first portion 322 and second portion 324 and grasp a portion of a safety harness to pass through the opening of garment 100. Thus, components of a safety harness are accessible to a user without having to take off garment 100.

Figure 21:
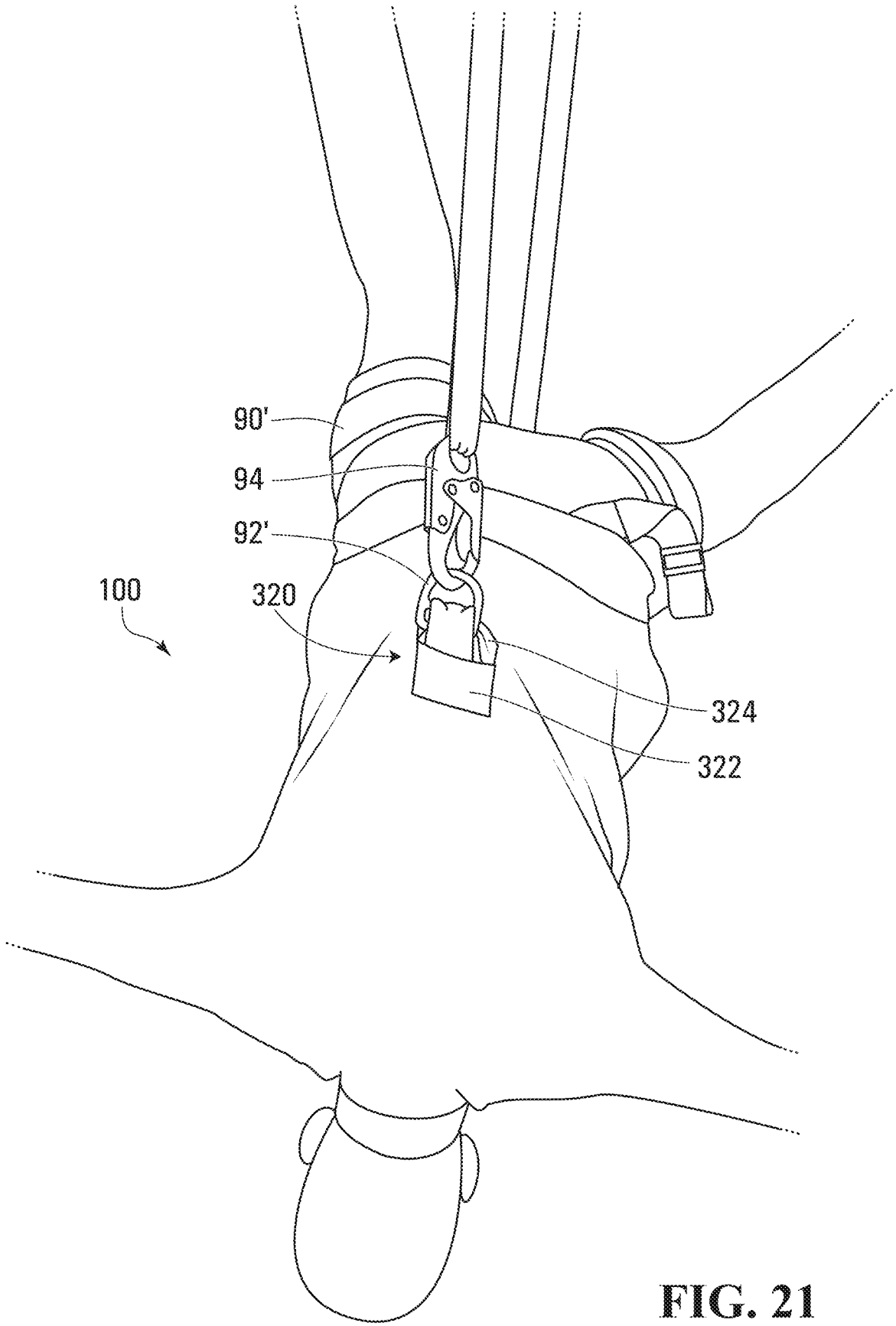
FIG. 21 is a rear view of the garment and the rear access of FIG. 19, with an attachment point in use, according to an embodiment.

FIG. 21 is a rear view of garment 100 and rear access 320, with an attachment point of safety harness 90' in use. As shown, in use, first portion 322 and/or second portion 324 of rear access 320 can stretch, bend, and flex, allowing to define an opening between first portion 322 and second portion 324 through which a portion of a safety harness can extend through. A user wearing garment 100 can therefore reach between first portion 322 and second portion 324 and grasp a portion of a safety harness to pass through the opening of garment 100. Thus, components of a safety harness are accessible to a user without having to take off garment 100.

Figure 22:
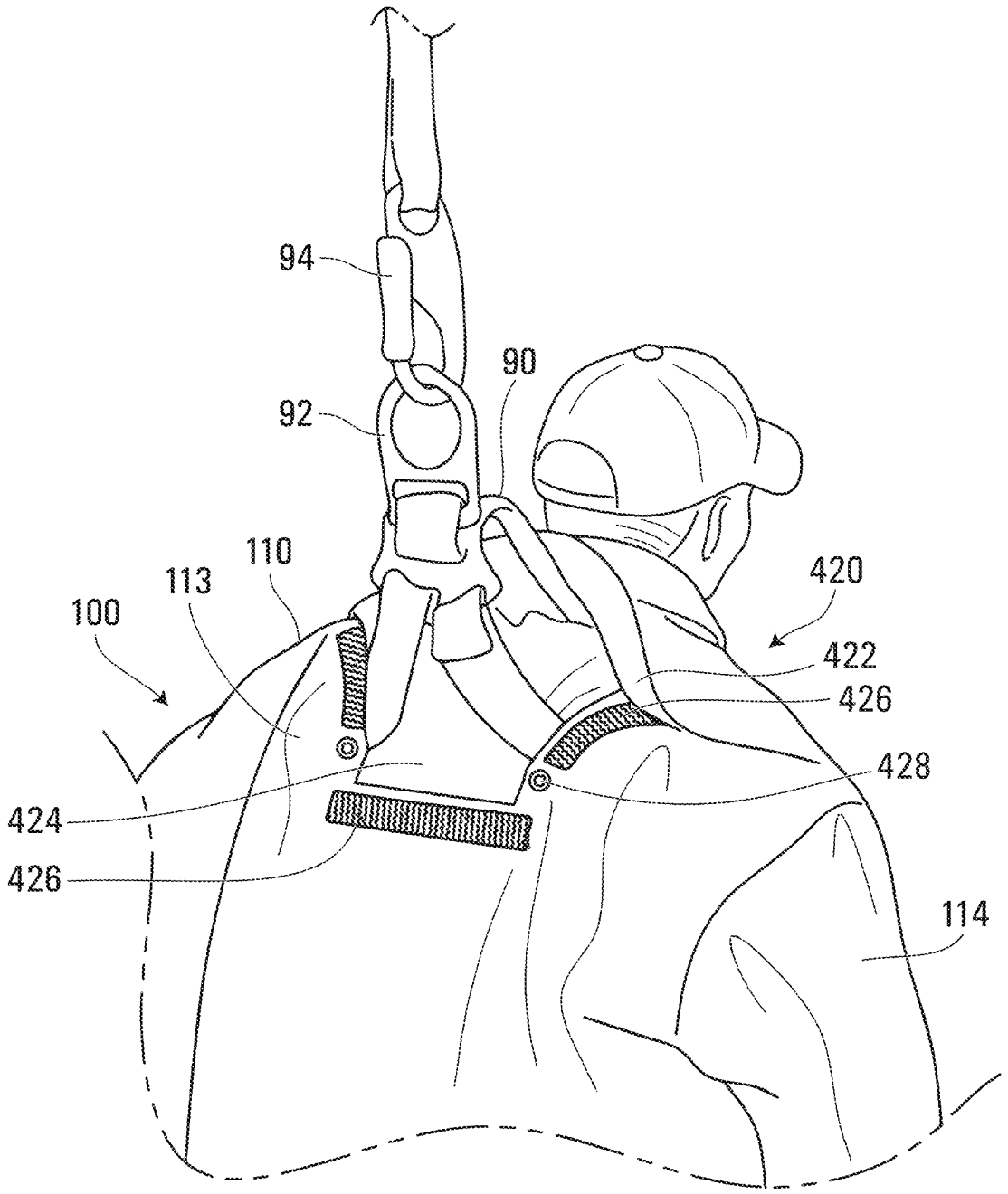
FIG. 22 is a rear perspective view of an outerwear garment with an access flap in an open condition and a safety harness extended therethrough with an attachment point attached to a lanyard, according to an embodiment.

FIG. 22 is a rear perspective view of garment 100 with flap access 420 in an open condition and safety harness 90 partially extended therethrough with attachment point 92 attached to lanyard 94, according to an embodiment.

As shown in FIG. 22, an aperture 424 can be disposed on garment body 110, for example, on rear side 113.

In some embodiments, flap access 420 includes a flap portion 422 disposed to cover aperture 424, for example, on rear side 113. A safety harness such as safety harness 90 can be worn prior to use between flap access 420 and, for example, an item of clothing worn by a user to cover the user's upper torso.

In the embodiment shown in FIG. 22, flap portion 422 includes a right-trapezoidal upper portion in an inverted position conjoined to a rectangular lower portion. The upper portion may have an upper side that extends generally horizontally along garment body 110, for example, along each of a shoulder seam of garment body 110 as well as a rear portion of a collar.

Flap portion 422 can have a right side, a left side, and a lower side, the lower side is shorter than the upper side and is centered on rear side 113 of garment body 110. Flap portion 422 can have surface area configured to cover safety harness 90. Aperture 424 may have the same configuration as flap portion 422.

One or more fasteners, for example, hook and loop fasteners 426 and/or snap fasteners 428, can be configured to allow for the automatic release of flap portion 422 and opening of flap access 420 when lanyard 94 extending from a D-ring attachment point 92 of safety harness 90 is pulled upwardly. Fasteners, such as hook and loop fasteners 426 and/or snap fasteners 428, may be disposed, for example, on each of flap portion 422 and garment body 110 on rear side 113, and adjacent the right side, the left side, and the lower side of the flap portion 422. Fasteners may be two-part fasteners, for example, hook and loop fastener 426 or snap fasteners 428, or other suitable fasteners, that disengage when a portion of safety harness 90, such as a D-ring attachment point 92 pulled by way of a lanyard 94, in an example, pulled upwardly in a manner similar to that illustrated in FIG. 22. Hook and loop fastener 426 may form a strip, for example, between one and two inches in width.

In some embodiments, one or more of the fasteners may be formed as one or more fastener seams formed by one or more rows of stitches sewn between flap portion 422 and garment body 110. Each stitch of a fastener seam may be a loop or a portion of at least one thread passing through flap portion 422 and garment body 110, for example a lock stitch formed by two threads.

Fastener seams may be configured to tear or separate when safety harness 90 is pulled upwardly, for example, by a lanyard extending from the D-ring of the harness. In such a configuration, the fastener seam may act as a point of failure, such that the fastener seam may tear or separate before the failure of another seam or fabric of the outerwear garment, for example, shoulder seam, when safety harness 90 is pulled upwardly.

In some embodiments, one or more of the fasteners, for example fastener seams, are configured to tear or separate, releasing flap portion 422 from garment body 110, when a tension in a lanyard extending from the D-ring of a safety harness approaches approximately equal to a user's weight, the user's weight being the gravitational force on a user's mass. As such, a tension force exerted by the lanyard will approximately equal a user's weight, for example, when the user is suspended mid-air by the safety harness, the lanyard extending generally vertically from the D-ring of the safety harness. This may occur, for example, if the user slips and shortly before being caught by the safety harness in mid-air.

To achieve tearing or separation when tension in the lanyard approaches approximately a user's weight, the user's weight being approximately 100-200 lbs, preferably between 150-175 lbs, the combination of fabric of flap portion 422 and garment body 110 and one or more fastener seams may be such that each stitch of the one or more fastener seams may, for example, be 2 mm to 4 mm in length, forming a row of stitching 20 mm to 30 mm in length, of which one to three rows of stitching form a fastener seam. A fastener seam may extend perpendicularly with reference to a shoulder seam. The thread used for a stitch may be a cotton or synthetic material, and may have a mass, for example between tex 40 and tex 45, where tex is the mass in grams of 1,000 meters of thread.

The opening of flap portion 422 permits access to, exposure, and use of the D-ring of the fall-arrest harness worn underneath the garment body 110, for anchoring the wearer to an anchor point to prevent falling from the precarious situation. The fasteners may permit the flap portion 422 to open for use of the fall-arrest harness without substantially pulling garment body 110 out of position. For example, with flap portion 422 open, aperture 424 may allow at least a portion of the fall-arrest harness to extend therethrough, thereby preventing safety harness 90 from displacing garment body 110 in such a way that would substantially restrict the user's breathing when a lanyard extending from the D-ring of the fall-arrest harness has a tension approximately equal to the weight of the user. This may occur, for example, when the user slips and is caught by the fall-arrest harness.

Aperture 424 may be approximately as wide as the distance between back straps of safety harness 90 positioned on a user's shoulders, to allow at least a portion of safety harness 90 to extend therethrough. For example, aperture 424 may allow at least a portion of back straps of safety harness 90, and a back pad assembly connecting the D-ring to the back straps, to extend therethrough when lanyard 94 is pulled upwardly. Flap portion 422 also permits the outerwear garment body to be reused.

Accesses as disclosed herein, such as one or more of pocket access 120, front access 220, rear access, flap access 420, shoulder access 2720 in any combination, may prevent garment 100 from being substantially displaced, for example, in a way that could reduce a user's mobility or potentially restrict a user's breathing, with use of a safety harness such as safety harness 90 with various attachment points accessed through the accesses. It will be appreciated that although the Figures depict various example configurations, this is not intended to be an exhaustive list of configurations, and that a combination of one or more accesses depicted in different figures may be combined in one garment (which may allow for various different types of harnesses and other safety devices to be used with enhanced safety and reduced risk of complications or failure). Using a combination of one or more accesses may improve the ability of a safety harness to move without substantially displacing garment 100, further improving a user's mobility and reducing the risk of garment 100 restraining the user in an unsafe manner, while retaining functionality of the safety harness, thus improving the safety of the user during use.

Of course, the above described embodiments are intended to be illustrative only and in no way limiting. The described embodiments are susceptible to many modifications of form, arrangement of parts, details and order of operation. The disclosure is intended to encompass all such modification within its scope, as defined by the claims.

What is claimed is:

1. A garment for use by a user wearing a safety harness, the garment comprising:

a garment body having a front side, a rear side, and a bottom edge;

a pocket comprising an interior and a pocket access permitting access to said interior of said pocket;

said pocket access including an opening adjacent the pocket, said opening having a shape defined in the front side of the garment body and partially retained by a flexible portion, said flexible portion forming part of the bottom edge of said garment, said opening permitting access to an interior of said garment, wherein said interior of said pocket is between said front side of said garment and said interior of said garment;

a releasable closure adjustable between a closed configuration in which said releasable closure covers said opening and prevents access to said interior of said garment and permits access to said interior of said pocket from said front side of said garment, and an open configuration in which said releasable closure permits access to said interior of said garment via said opening, wherein the flexible portion is configured to allow the shape of the opening to expand to allow a portion of the safety harness to extend through the opening without displacing the garment body.

2. The garment of claim 1, wherein the opening is offset from a vertical midline axis of the front side of the garment and proximal to said bottom edge of the garment.

3. The garment of claim 1, wherein the flexible portion is formed from elasticized fabric.

4. The garment of claim 1, wherein the closure is a fabric flap having a fastener disposed thereon, and an interior of said pocket comprises a corresponding fastener to said fastener disposed on said fabric flap.

5. The garment of claim 1, wherein the garment is a jacket, a shirt, or coveralls.

* * * * *